US005990404A

United States Patent [19]

Miyano

[11] Patent Number: 5,990,404

[45] **Date of Patent: *Nov. 23, 1999**

[54] PERFORMANCE DATA EDITING APPARATUS

[75] Inventor: Yasuhisa Miyano, Hamamatsu, Japan

[73] Assignee: Yamaha Corporation, Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/784,018

[22] Filed: Jan. 15, 1997

[30] Foreign Application Priority Data

Jan. 17, 1996 [JP] Japan ..... 8-006186
Jan. 17, 1996 [JP] Japan ..... 8-006187
Jan. 17, 1996 [JP] Japan ..... 8-006188

[51] Int. Cl.[6] ..... G10H 1/02; G10H 1/30; G10H 1/46

[52] U.S. Cl. ..... 84/609; 84/602; 84/615; 84/626; 84/633

[58] Field of Search ..... 84/601–602, 609–610, 84/615, 626, 630, 633, 634, 649, 650, 653, 662, 665

[56] References Cited

U.S. PATENT DOCUMENTS 3,844,379 10/1974 Tomisawa et al. ..... 84/1.01
5,488,196 1/1996 Zimmerman et al. ..... 84/612

*Primary Examiner*—Robert E. Nappi
*Assistant Examiner*—Marlon Fletcher
*Attorney, Agent, or Firm*—Pillsbury Madison & Sutro LLP

[57] ABSTRACT

A performance data editing apparatus is realized by a computer system and/or an electronic musical instrument to provide rich expressions of an automatic performance by performing a variety of editing processes on performance data. Herein, the performance data correspond to multiple parts of the music played by the automatic performance, so at least one of the parts is designated as an editing part. For example, a velocity expander editing process is provided to broaden a distribution range of velocity data representing tone volumes of musical tones of the editing part. Thus, it is possible to emphasize ups and downs in variations of the tone volumes with respect to the editing part. A sound duplication editing process is provided to duplicate generation of a same musical tone under a condition where a shortage of tone-generation channels does not occur. Thus, it is possible to produce a marrowy and thick musical tone with respect to the editing part. Further, a timing tuner editing process is provided to perform an adjustment such that playback timings of the musical tones of the editing part will substantially coincide with desired playback timings which are requested by a human operator.

9 Claims, 15 Drawing Sheets

0 : STORE
1 : PLAYBACK
2 : EDIT
3 : MIDI DATA CREATION

| CH | 0 | 1 | 2 | .... | 15 |
|---|---|---|---|---|---|
| EXP(CH) | 0 | 1 | 1 | .... | 0 |
| MIN(CH) | 10 | 20 | 10 | .... | 10 |
| MAX(CH) | 120 | 127 | 100 | .... | 120 |

| CH | 0 | 1 | 2 | .... | 15 |
|---|---|---|---|---|---|
| DBL(CH) | 0 | 1 | 0 | .... | 1 |

| CH | 0 | 1 | 2 | .... | 15 |
|---|---|---|---|---|---|
| TUN(CH) | 1 | 0 | 0 | .... | 1 |

| FIRST BYTE (KEY-ON STATUS) | | SECOND BYTE | THIRD BYTE |
|---|---|---|---|
| 9 | CH | NOTE NUMBER | VELOCITY |

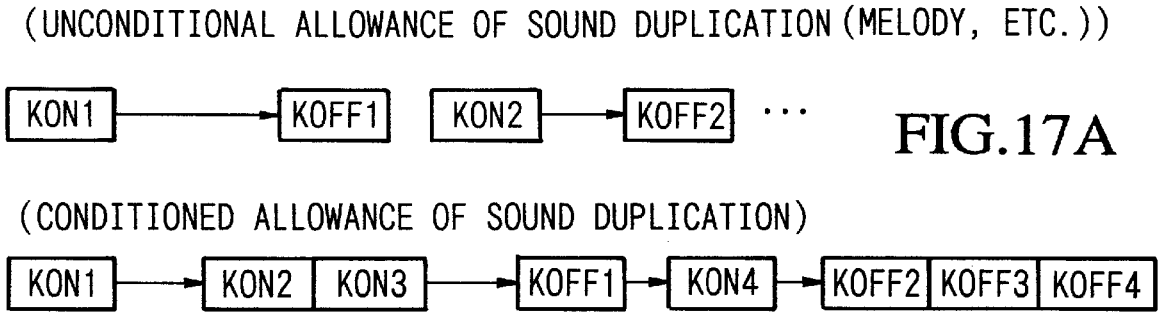
FIG.17A
FIG.17B
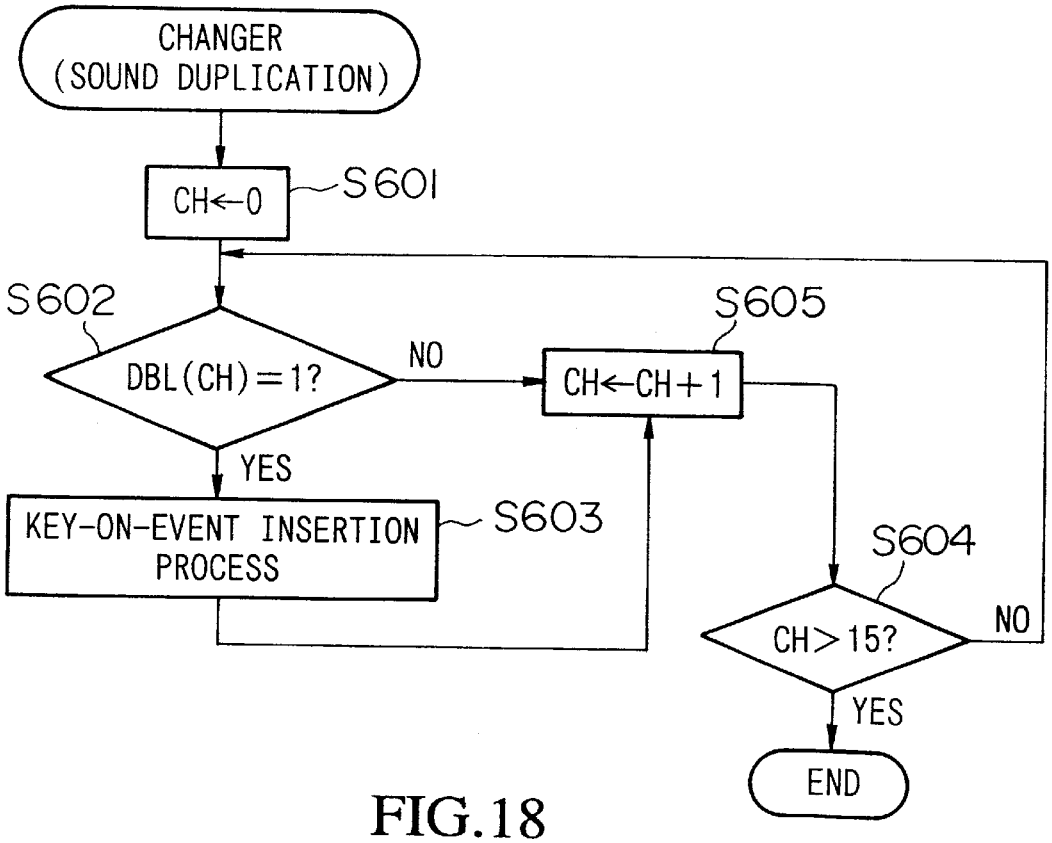
FIG.18

PERFORMANCE DATA EDITING APPARATUS

BACKGROUND OF THE INVENTION

1. Field of the Invention

The invention relates to apparatuses which are capable of editing performance data.

2. Prior Art

Recently, there are provided a variety of personal computers equipped with sound sources as well as software programs handling performance data. So, everyone can enjoy creating and playing computer music with ease. In the personal computer having a capability of handling the computer music, for example, a user (or a human operator) manipulates a keyboard to input performance data by each step, so it is possible to edit a series of performance data representing sounds which are comprehensible as the music. Therefore, even a person who is not accustomed to playing musical instruments or a person who cannot play musical instruments at all is capable of enjoying creation of the music such as the composition and arrangement of the music.

As described above, the keyboard of the computer is manipulated to create performance data, wherein manipulation of the keyboard of the computer is made in order to play the musical performance. However, such a 'mechanical' manipulation of the keyboard of the computer is very much different from the actual playing of the musical instruments by which the intention and feelings of the human being can be directly presented. So, it seems that an automatic performance having a rich expression may not be achieved by the mechanical manipulation of the keyboard of the computer which is very much different from the musical presentation of the intention and feelings of the human being. Herein, a 'computerized' automatic performance is carried out by an electronic musical instrument based on performance data which are edited using the computer. As compared with the actual performance of an electronic musical instrument which is actually played by a person, the computerized automatic performance merely provides monotonous sounds which merely offer a 'flat' impression or an 'expressionless' impression. Such a monotonousness is enhanced when the person manipulates the computer to create performance data with merely looking at a musical score. In such a case, an automatic performance should lack individuality.

SUMMARY OF THE INVENTION

It is an object of the invention to provide a performance data editing apparatus which is capable of finely editing performance data by which an automatic performance is improved to have a rich expression.

A performance data editing apparatus of the invention is realized by a computer system and/or an electronic musical instrument to provide rich expressions of an automatic performance by performing a variety of editing processes on performance data. Herein, the performance data correspond to multiple parts of the music played by the automatic performance, so at least one of the parts is designated as an editing part.

The editing processes are provided to enhance musical tones of the editing part. For example, a velocity expander editing process is provided to broaden a distribution range of velocity data representing tone volumes of musical tones of the editing part. Thus, it is possible to emphasize ups and downs in variations of the tone volumes with respect to the editing part. A sound duplication editing process is provided to duplicate generation of a same musical tone under a condition where a shortage of tone-generation channels does not occur. Thus, it is possible to produce a marrowy and thick musical tone with respect to the editing part. Further, a timing tuner editing process is provided to perform an adjustment such that playback timings of the musical tones of the editing part will substantially coincide with desired playback timings which are requested by a human operator.

BRIEF DESCRIPTION OF THE DRAWINGS

These and other objects of the subject invention will become more fully apparent as the following description is read in light of the attached drawings wherein:

FIG. 17A shows a relationship between sounding durations which do not overlap with each other;

FIG. 17B shows a relationship between sounding durations which partially overlap with each other;

FIG. 18 is a flowchart showing a changer of the sound duplication editing process;

DESCRIPTION OF THE PREFERRED EMBODIMENT

Now, a preferred embodiment of the invention will be described with reference to the drawings.

[A] Configuration of the Embodiment

Figure 1:
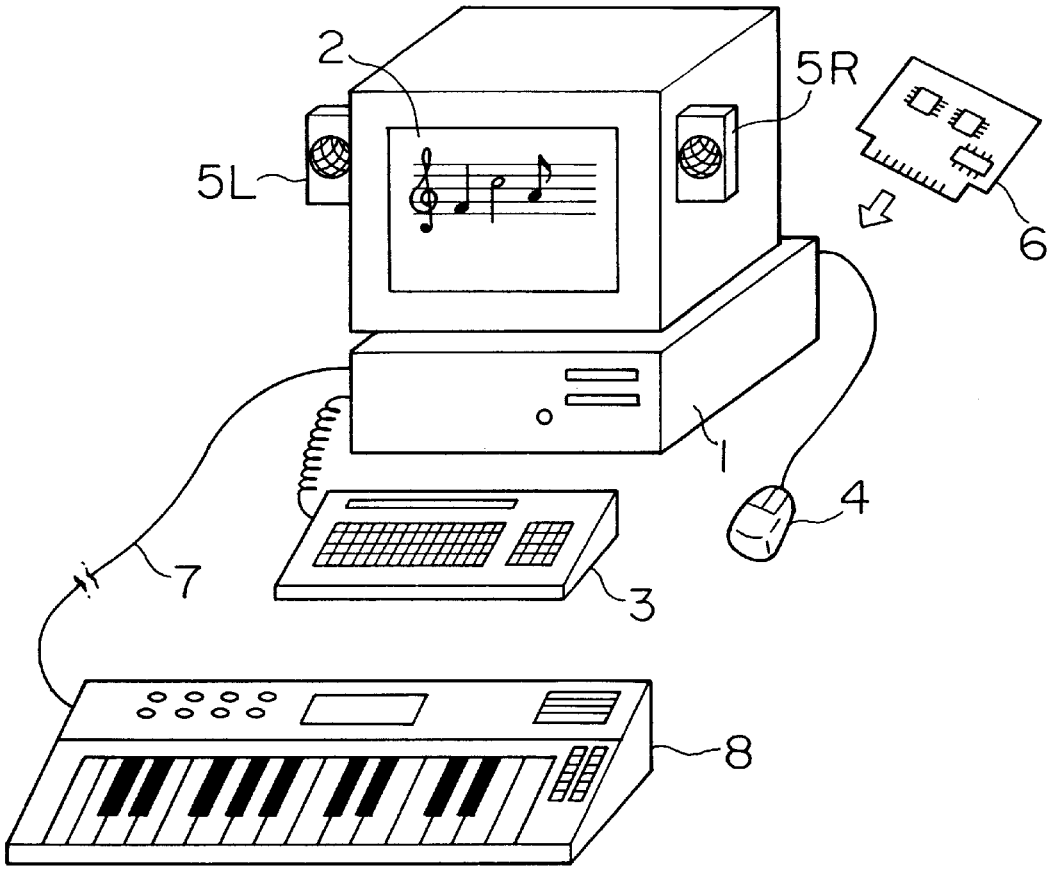
FIG. 1 is a perspective view illustrating a computer system which corresponds to a performance data editing apparatus which is designed in accordance with an embodiment of the invention.

FIG. 1 is a perspective view illustrating a computer system which corresponds to a performance data editing apparatus which is designed in accordance with an embodiment of the invention. Herein, a general personal computer is employed to construct the performance data editing apparatus of the present embodiment. In addition, a sound source is built in the personal computer in which software programs realizing editing of performance data are installed. Specifically, the computer system of FIG. 1 is constructed by a computer's main body 1, a CRT display unit 2, a keyboard 3, a mouse 4 and speakers 5L, 5R. In addition, a sound source board 6 is inserted into and stored in the main body 1. The sound source board 6 is of a polyphonic type and is designed to have a capability of simultaneously generating multiple sounds by use of multiple tone-generation channels. Further, a keyboard-type electronic musical instrument 8 is connected to the main body 1 via a MIDI cable 7 (where 'MIDI' is an abbreviation for 'Musical Instrument Digital Interface').

Figure 2:
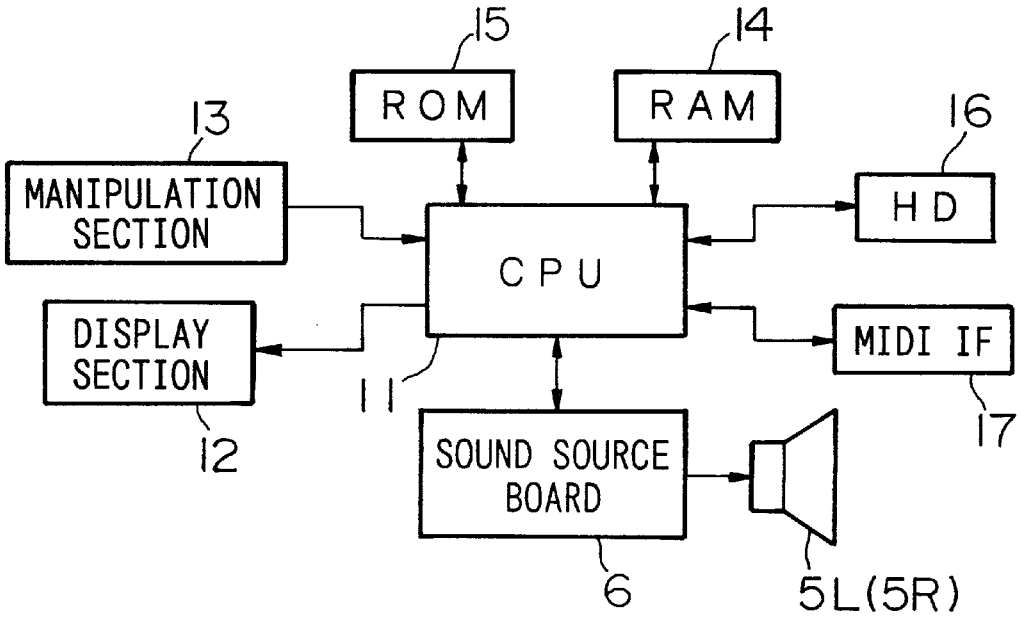
FIG. 2 is a block diagram showing an electronic configuration of internal circuits of the computer system.
Figures 3A, 3B, 3C, 3D:
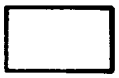
FIGS. 3A, 3B, 3C and 3D show control registers which are used by the present embodiment.

FIG. 2 shows an electronic configuration corresponding to internal circuits which are provided inside of the main body 1. Herein, a CPU 11 performs overall control on circuits of the performance data editing apparatus of the present embodiment. Under the control of the CPU 11, a display section 12 performs a display control on display members such as the CRT display unit 2. A manipulation section 13 is provided in connection with manipulation members such as the keyboard 3 and the mouse 4. So, the CPU 11 detects manipulation through the manipulation section 13. A RAM 14 is provided as a work area for the CPU 11. A variety of control registers are set to the RAM 14, wherein they are required for the CPU 11 to perform a variety of control operations. FIGS. 3A to 3D show 4 kinds of control registers which are mainly used by the present embodiment among the control registers set to the RAM 14. In addition, the RAM 14 is used as a storage to store performance data in an automatic performance mode or in an edit mode to edit performance data. Moreover, a ROM 15 stores edit programs used to perform editing of the performance data as well as a variety of control programs which are executed by the CPU 11.

A hard disk unit (HD) 16 is a storage of large capacity which stores performance data as well as various kinds of information. The CPU 11 can be connected to some external devices such as an electronic musical instrument externally provided via a MIDI interface (MIDI IF) 17 (where 'MIDI' is an abbreviation for 'Musical Instrument Digital Interface'). So, transmission of MIDI data can be performed between the CPU 11 and external device via the MIDI interface 17. The aforementioned MIDI cable 7 shown in FIG. 1 is connected to the MIDI interface 17. Moreover, a musical tone generating unit, constructed by the sound source board 6 and speakers 5L, 5R shown in FIG. 1, is also placed under the control of the CPU 11.

The performance data editing apparatus of the present embodiment provides 4 kinds of operation modes. Each of the operation modes is presented by the CPU 11 to execute control programs which are provided for each mode and are stored in the ROM 15. Now, the 4 kinds of operation modes will be described hereinbelow.

(1) Store Mode

When a store mode is set to the CPU 11, the CPU 11 executes programs stored in the ROM 15. At the store mode, performance data based on the MIDI standard are stored in the RAM 14. Herein, the performance data are successively inputted to the apparatus in accordance with step input operations in a MIDI data creation mode (whose content will be described later); or the performance data are given from the external device, such as the electronic musical instrument, and are inputted to the apparatus via the MIDI interface 17.

(2) Playback Mode

When a playback mode is set to the CPU 11, the CPU 11 executes playback programs stored in the ROM 15. At the playback mode, the apparatus is placed under the control of the CPU 11 so that various kinds of information are sent to the sound source board 6 in accordance with performance data stored in the RAM 14, and an automatic performance is played based on the performance data.

(3) Edit Mode

When the edit mode is set to the CPU 11, the CPU 11 executes edit programs stored in the ROM 15. The edit mode allows the apparatus to change, delete and add performance data. In addition, the edit mode allows the apparatus to execute 'characteristic' editing processes which will be described below. Each of the editing processes is activated by a user who designates a specific MIDI channel. So, only the performance data which correspond to the specific MIDI channel are selected as data to be processed by the editing process.

(a) Velocity Expander Editing Process

Velocity data (or tone volume data) are provided as one constructive element of the performance data to determine a tone volume for the sounding. The velocity expander editing process deals with velocity data which are provided for a specific MIDI channel. That is, the velocity expander editing process expands a distribution range of the above velocity data each so as to keep the above velocity data as a whole within a certain range. In other words, the velocity expander editing process increases ups and downs in variations of tone volumes with respect to a specific part of the music played at an automatic performance mode. So, this process offers an effect to give a striking impression to the specific part.

(b) Sound Duplication Editing Process

In a multi-channel sounding mode where multiple tone-generation channels of the sound source board 6 are used to form a same musical tone in a duplicating manner, it is possible to obtain a 'marrowy' or 'thick' musical tone as compared to a single-channel sounding mode where a single channel is used to form a musical tone. The sound duplication editing process is provided to demonstrate such a duplicating effect with respect to a specific part of the music. The sound duplication editing process responds to a key-on event regarding a specific MIDI channel. That is, this process adds a 'duplicate' key-on event which duplicates an existing key-on event which has been already designated. If addition of such a duplicate key-on event is made unconditionally, there is a possibility that a number of tone-generation channels required will be shorted. In order to avoid such a shortage of the tone-generation channels, the present embodiment is designed to make an addition of a duplicate key-on event only in a limited condition. That is, the apparatus of the present embodiment normally recognizes a series of existing key-on events which occur in a time-series manner, so the apparatus allows an addition of a duplicate key-on event if the present situation meets a condition that a shortage of tone-generation channels does not occur.

(c) Timing Tuner Editing Process

The timing tuner editing process is provided to adjust a playback timing of a key-on event of a specific MIDI channel based on 'real' performance data. Herein, the real performance data correspond to performance data which are made by recording real performance of musical instruments; or the real performance data are created by manipulation of the keyboard 3.

(4) MIDI Date Creation Mode

The MIDI data creation mode is an operation mode where performance data are successively created by each step by manipulation of the manipulation members such as the keyboard 3 and the mouse 4.

Next, a description will be given with respect to some control registers which are mainly used by the present embodiment among the control registers set in the RAM 14.

(a) Mode Register

By manipulating the keyboard 3 or the mouse 4, a user is capable of designating a desired mode which is selected from among the store mode, playback mode, edit mode and MIDI data creation mode. Herein, numbers '0' to '3' are respectively assigned to the above 4 modes. Mode designation information representing the mode which is designated by the user is set to the mode register.

(b) Expander Registers EXP, MIN, MAX

The expander registers are provided to store various kinds of information which are used to control the aforementioned velocity expander editing process. As the expander registers, there are provided 3 kinds of registers which are respectively designated by numerals 'EXP', 'MAX' and 'MIN'. Herein, the register EXP(CH) (where 'CH' denotes a number of a MIDI channel which ranges from '0' to '15') stores information, representing a decision as to whether or not to adopt the velocity expander editing process, with respect to each MIDI channel. If the velocity expander editing process is adopted for the MIDI channel having the channel number 'CH', '1' is set to the register, thus EXP(CH)=1. If not, '0' is set to the register, thus EXP(CH)=0. The register MAX (CH) (where 'CH' ranges from '0' to '15') stores an upper-limit value, which defines an upper limit of a distribution range of velocity data after execution of the velocity expander editing process, with respect to each MIDI channel. On the other hand, the register MIN(CH) (where 'CH' ranges from '0' to '15') stores a lower-limit value, which defines a lower limit of the distribution range of the velocity data after the execution of the velocity expander editing process, with respect to each MIDI channel. The upper-limit value and lower-limit value of the velocity data of each MIDI channel can be set by the user to manipulate the manipulation members such as the keyboard 3. If the setting is not made by the user, default values are automatically set to the upper-limit value and lower-limit value.

(c) Doubler Register DBL

The doubler register DBL(CH) (where 'CH' ranges from '0' to '15') stores information, representing a decision as to whether or not to adopt the aforementioned sound duplication editing process, with respect to each MIDI channel. If the sound duplication editing process is adopted for the MIDI channel of the channel number 'CH', '1' is set to the register, thus DBL(CH)=1. If not, '0' is set to the register, thus DBL(CH)=0.

(d) Tuner Register TUN

The tuner register TUN(CH) (where 'CH' ranges from '0' to '15') stores Information, representing a decision as to whether or not to adopt the aforementioned timing tuner editing process, with respect to each MIDI channel. If the timing tuner editing process is adopted for the MIDI channel of the channel number 'CH', '1' is set to the register, thus TUN(CH)=1. If not, '0' is set to the register, thus TUN (CH)=0.

[B] Operations of the Embodiment

Next, a description will be given with respect to operations of the present embodiment.

(1) Overall Operation

Figure 4:
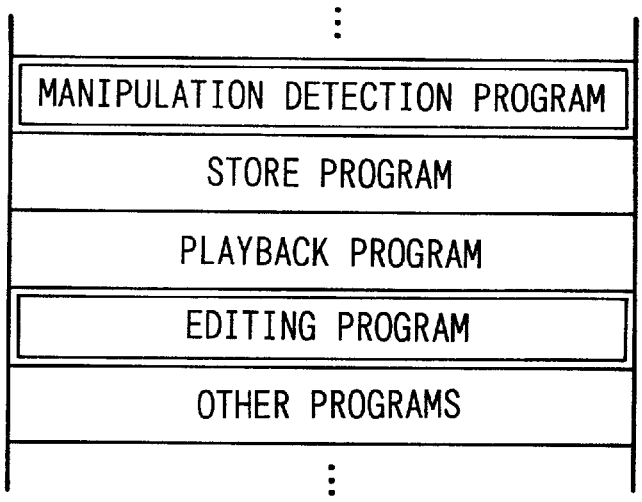
FIG. 4 shows a configuration of control programs which are stored in a ROM shown in FIG. 2.

When the user manipulates the manipulation members such as the keyboard 3 and the mouse 4, the manipulation section 13 issues an interrupt request to the CPU 11. Thus, the CPU 11 starts to execute a manipulation detection program (see FIG. 4), stored in the ROM 15, as an interrupt process.

Figure 5:
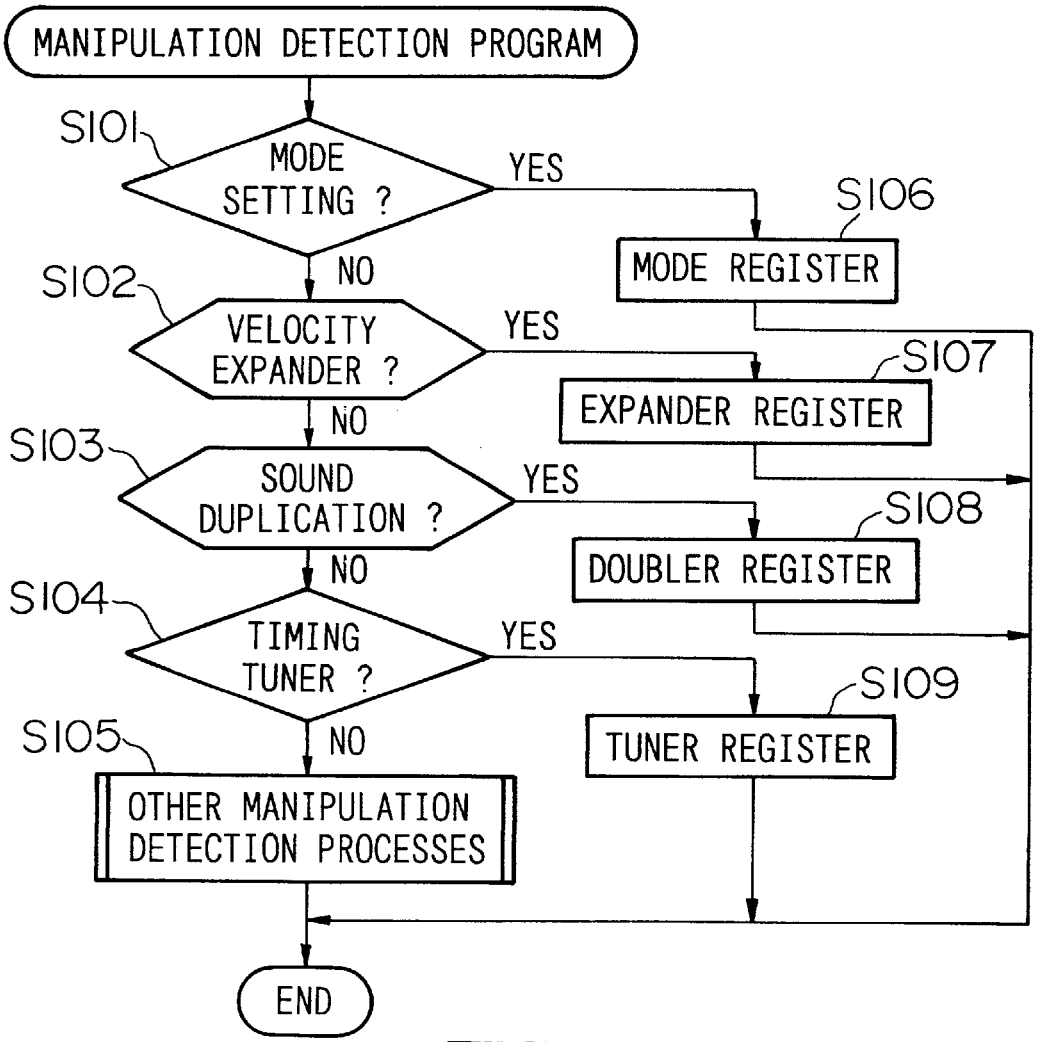
FIG. 5 is a flowchart showing a manipulation detection program.

Details of the manipulation detection program is shown in FIG. 5. In first step S101, the CPU 11 detects the content of the manipulation by means of the manipulation section 13. Thus, the CPU 11 makes a decision as to whether or not the manipulation is made to request the setting of the operation mode. If a result of the decision is "YES", the CPU 11 proceeds to step S106. Herein, the manipulation indicates mode designation information (whose number is selected from among a range of numbers '0' to '3') representing an operation mode which is selected from among the store mode, playback mode, edit mode and MIDI data creation mode. Thus, the mode designation information corresponding to the operation mode designated by the manipulation is set to the mode register. After completion of the step S106 described above, the CPU 11 ends an execution of the manipulation detection program.

If a result of the decision of the step S101 is "NO", the CPU 11 proceeds to step S102 so as to make a decision as to whether or not the detected manipulation, which is detected via the manipulation section 13, designates the velocity expander editing process. If a result of the decision is "YES", the CPU 11 proceeds to step S107 so as to set control information which is required to execute the velocity expander editing process. That is, if the manipulation designates the velocity expander editing process, the user inputs a number of a MIDI channel to be processed by the velocity expander editing process as well as an upper-limit value and a lower-limit value which define a distribution range of velocity data after the velocity expander editing process. So, '1' is set to the register EXP(CH) which corresponds to the inputted channel number 'CH' of the MIDI channel, whilst the upper-limit value and lower-limit value are respectively set to the registers MAX(CH) and MIN(CH). Incidentally, the user is capable of omitting the inputting of the upper-limit value and lower-limit value. In such a case, certain default values (e.g., '120' and '10') are set to the registers MAX(CH) and MIN(CH) respectively. After completion of the setting of data for the above registers, the CPU 11 ends an execution of the manipulation detection program.

On the other hand, if a result of the decision of the step S102 is "NO", the CPU 11 proceeds to step S103 so as to make a decision as to whether or not the detected manipulation designates the sound duplication editing process. If a result of the decision is "YES", the CPU 11 proceeds to step S108. Herein, the CPU 11 detects a channel number of a MIDI channel, which the user selects for the sound duplication editing process, by means of the manipulation section 13. So, '1' is set to the doubler register corresponding to the detected channel number of the MIDI channel, thus DBL (CH)=1. Then, the CPU 11 ends an execution of the manipulation detection program.

If a result of the decision of the step S103 is "NO", the CPU 11 proceeds to step S104 so as to make a decision as to whether or not the detected manipulation designates the timing tuner editing process. If a result of the decision is "YES", the CPU 11 proceeds to step S109. Herein, the CPU 11 detects a channel number of a MIDI channel which the user selects for the timing tuner editing process. So, '1' is set to the tuner register which corresponds to the detected channel number of the MIDI channel, thus TUN(CH)=1. Then, the CPU 11 ends an execution of the manipulation detection program.

If a result of the decision of the step S104 is "NO", the CPU 11 proceeds to step S105 to execute other manipulation detection processes whose contents are different from the contents of the aforementioned steps S102 to S104. Thereafter, the CPU 11 ends an execution of the manipulation detection program.

Figure 6:
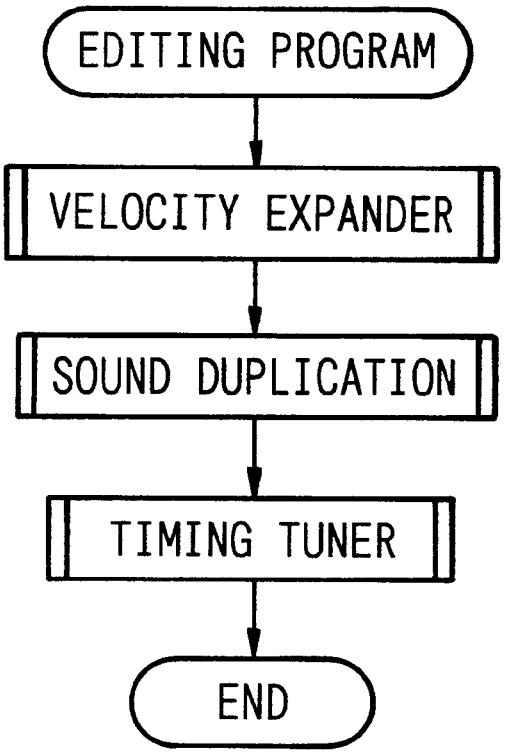
FIG. 6 is a flowchart showing an editing program.

When the user sets the edit mode, the CPU 11 starts to execute the editing program stored in the ROM 15. As shown in FIG. 6, the editing program consists of 3 kinds of editing subprograms which are provided for the velocity expander editing process, sound duplication editing process and timing tuner editing process respectively.

Figure 7:
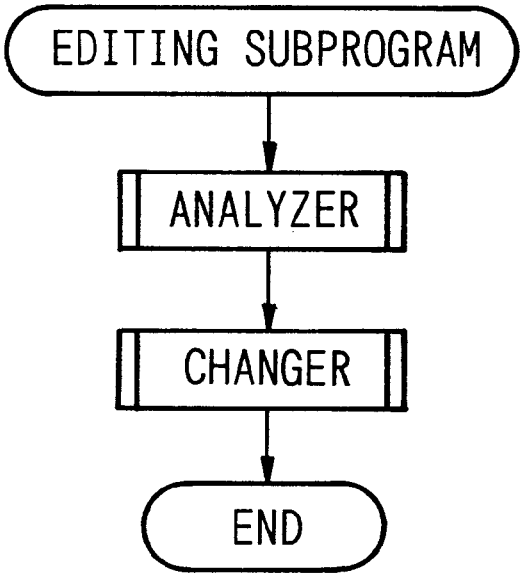
FIG. 7 is a flowchart showing a fundamental configuration of an editing subprogram.

Each of the editing subprograms consists of 2 kinds of programs which correspond to an analyzer and a changer (see FIG. 7). Herein, the changer represents a program which performs an editing process on performance data in accordance with each editing subprogram. The analyzer represents a program which analyzes the performance data, which are subjected to the editing process, so as to extract 'necessary' information from the performance data, wherein the necessary information represents the information which is necessary to make an execution of the changer. So, an execution of the analyzer is made prior to the execution of the changer.

Figure 8:
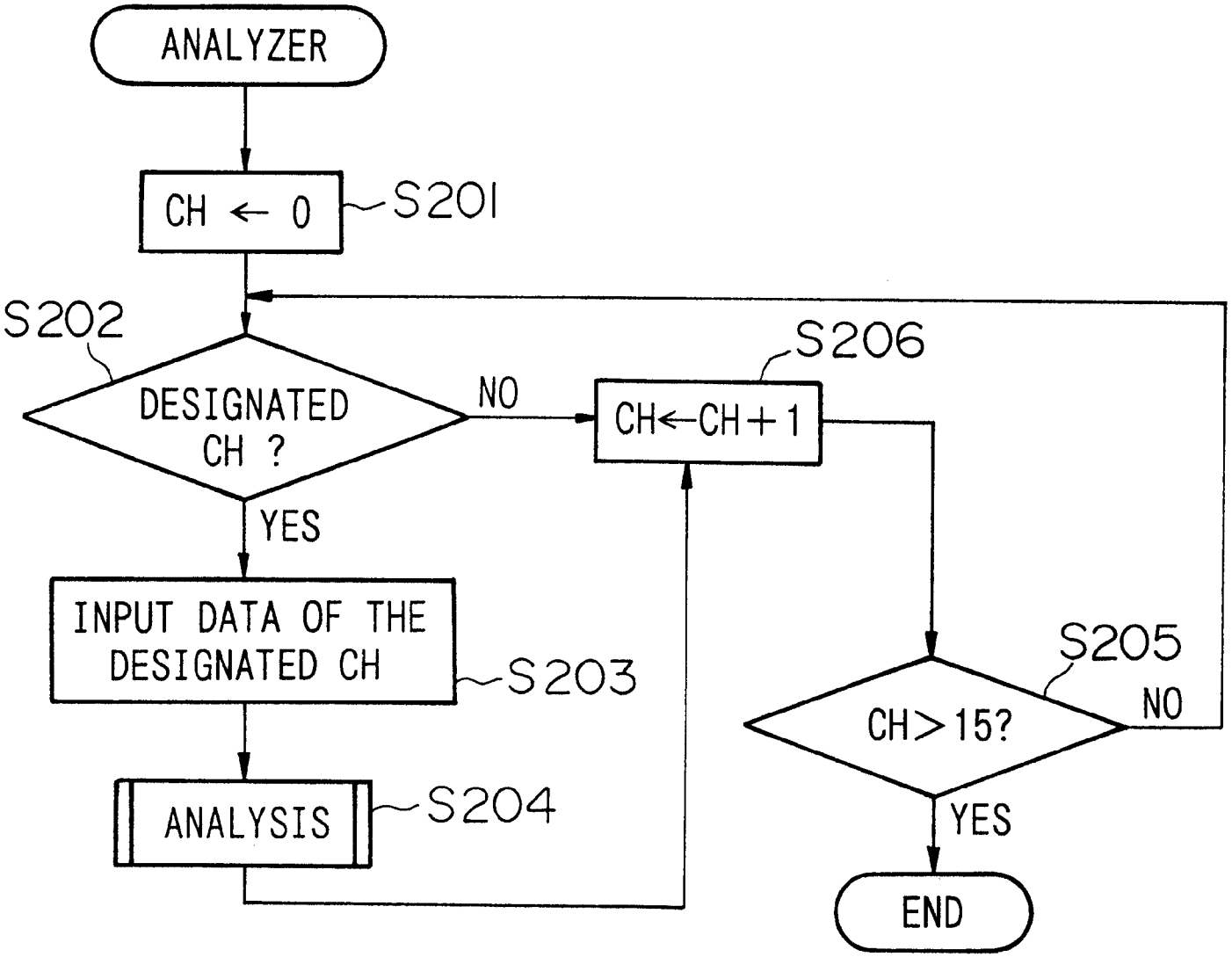
FIG. 8 is a flowchart showing a detailed content of an analyzer shown in FIG. 7.

The concrete contents of processing of the analyzer and changer are determined in response to each of the editing subprograms. A flowchart of FIG. 8 shows a fundamental content of processing of the analyzer which can be applied to the editing subprograms each. In the flowchart of FIG. 8, the system of the present embodiment performs an analysis of performance data as well as an extraction of necessary information. Herein, steps S201, S205 and S206 are provided to successively change a channel number 'CH' of a MIDI channel from '0' to '15'. So, the system makes a decision (see S201) as to whether or not each of the channel numbers successively changed represents a MIDI channel which is selected for some editing process. In case of the analyzer provided for the velocity expander editing process, for example, the system makes a decision (see S202) as to whether or not '1' is set to the register EXP(CH). So, a result of the decision turns to "YES" with respect to a certain channel number. In that case, the work area of the RAM 14 inputs performance data corresponding to a MIDI channel of the certain channel number (see S203). Then, the system analyzes the inputted performance data to extract necessary information for the changer which follows the analyzer (see S204). After completion of the aforementioned steps of the analyzer, the system proceeds to the changer which is executed based on the necessary information extracted by the analyzer. Thus, the system completely executes the velocity expander editing process, sound duplication editing process or timing tuner editing process.

Next, a detailed description will be given with respect to the concrete contents of processing of the velocity expander editing process, sound duplication editing process and timing tuner editing process in turn.

(2) Velocity Expander Editing Process

Figures 9, 10:
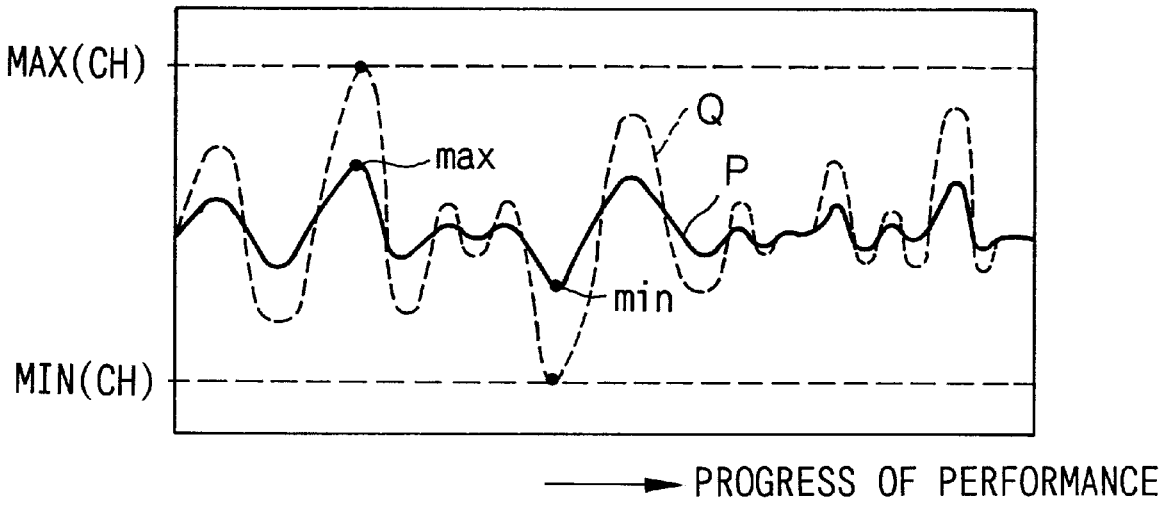
FIG. 9 is a graph showing waveforms which are used to explain an effect of a velocity expander editing process.
FIG. 10 shows a data configuration of a key-on event which is subjected to the velocity expander editing process.

FIG. 9 shows waveforms representing velocity data which are disposed in accordance with a progress of performance. Herein, the velocity data are provided for a MIDI channel, having a channel number 'CH', selected from among MIDI channels which are designated for the velocity expander editing process. Specifically, a solid curve shows an example of a waveform 'P' which represents variations of the velocity data before being processed by the velocity expander editing process, whilst a dotted curve shows an example of a waveform 'Q' which represents variations of the velocity data after being processed by the velocity expander editing process. Those waveforms show the property of the velocity expander editing process which broadens a distribution range of the velocity data each so as to keep the velocity data as a whole in a range which is defined by the upper-limit value set to the register MAX(CH) and the lower-limit value set to the register MIN(CH).

At least one MIDI channel, corresponding to EXP(CH)=1, is designated for the velocity expander editing process. So, the analyzer of the velocity expander editing process performs an analysis process to calculate a maximum value 'max' and a minimum value 'min' (see FIG. 9) of velocity data with respect each of the designated MIDI channels.

Figure 11:
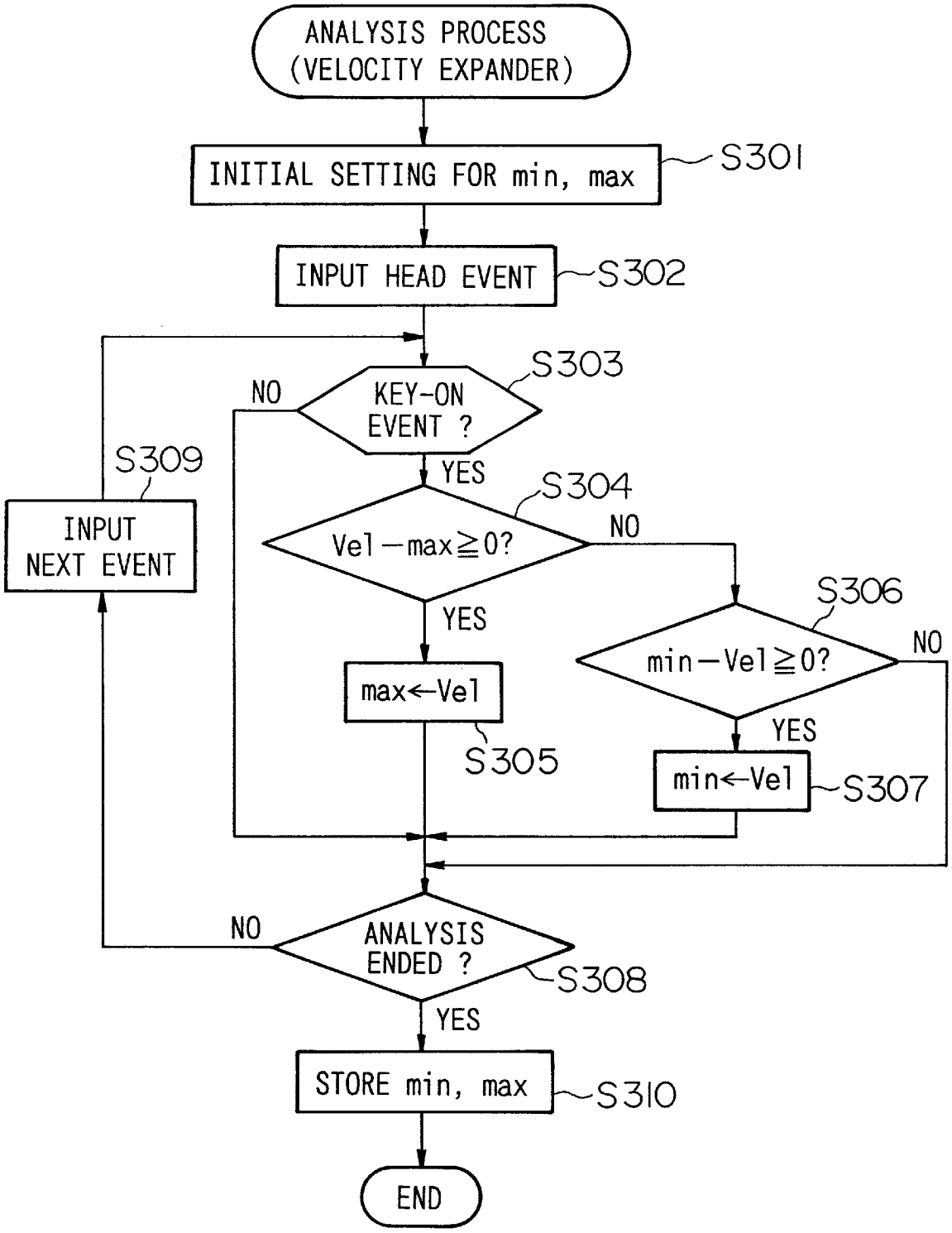
FIG. 11 is a flowchart showing an analysis process of the velocity expander editing process.

The analysis process directly deals with the velocity data which are contained in data of a key-on event constructing a part of performance data. FIG. 10 shows a data format of the key-on event. The data of the key-on event are configured by information of 3 bytes. Herein, a first byte represents a key-on status in which high-order 4 bits designate an identification code (e.g., '9') of the key-on event, whilst low-order 4 bits designate a channel number 'CH' of a MIDI channel corresponding to the key-on event. A second byte designates a note number of a musical tone which should be generated responsive to the key-on event. A third byte designates the velocity data which the analysis process directly deals with. In order to calculate the maximum value 'max' and minimum value 'min' of the velocity data, the system of the present embodiment pays an attention to only the performance data corresponding to the key-on event, so that a decision for magnitude comparison is made with respect to its third byte representing the velocity data. FIG. 11 shows a flow of steps representing the analysis process. Incidentally, the analysis process of FIG. 11 corresponds to step S204 shown in FIG. 8. Hereinbelow, a detailed description will be given with respect to the analysis process with reference to the flowchart of FIG. 11.

In first step S301, initialization (or initial setting) is performed on a maximum value 'max' and a minimum value 'min'. Next, the system of the present embodiment inputs a head event from performance data corresponding to a MIDI channel which is designated for the analyzer of the velocity expander editing process (see step S302). In step S303, a decision is made as to whether or not high-order 4 bits of a first byte of the inputted head event designate '9'; in other words, a decision is made as to whether or not the inputted head event designates a key-on event. If a result of the decision is "YES", the system proceeds to step S304. If a result of the decision is "NO", the system proceeds directly to step S308.

In step S304, the system refers to velocity data 'Vel' which are placed at a third byte of data of the key-on event currently inputted. So, a decision is made as to whether or not the velocity data Vel are equal to or greater than the maximum value 'max' which is currently set. If a result of the decision is "YES", the system proceeds to step S305 so as to renew the maximum value 'max' by the velocity data Vel. Then, the system proceeds to step S308. On the other hand, If a result of the decision of the step S304 is "NO", the system proceeds to step S306. In step S306, a decision is made as to whether or not the velocity data Vel of the currently inputted key-on event is equal to or less than the minimum value 'min' which is currently set. If a result of the decision is "YES", the system proceeds to step S307 so as to renew the minimum value 'min' by the velocity data Vel. Then, the system proceeds to step S308. If a result of the decision of the step S308 is "NO", the system proceeds directly to step S308 without executing the step S307.

In step S308, a decision is made as to whether or not the aforementioned steps are completely performed on all the events corresponding to the MIDI channel designated for the velocity expander editing process; in other words, a decision is made as to whether or not the analysis can be ended. If a result of the decision is "NO", the system proceeds to step S309 so as to input a next event next to the currently inputted event. So, the system repeats the aforementioned steps S303 to S308 with respect to the next event. Thus, a series of steps S303 to S308 are repeatedly performed on all the events corresponding to the MIDI channel designated for the velocity expander editing process. Thereafter, when a result of the decision of the step S308 turns to "YES", the system proceeds to step S310. In step S310, the maximum value 'max' and minimum value 'min' which are currently presented are stored in a predetermined storage area of the RAM 14. Thereafter, the analysis process on the MIDI channel is ended.

Figure 12:
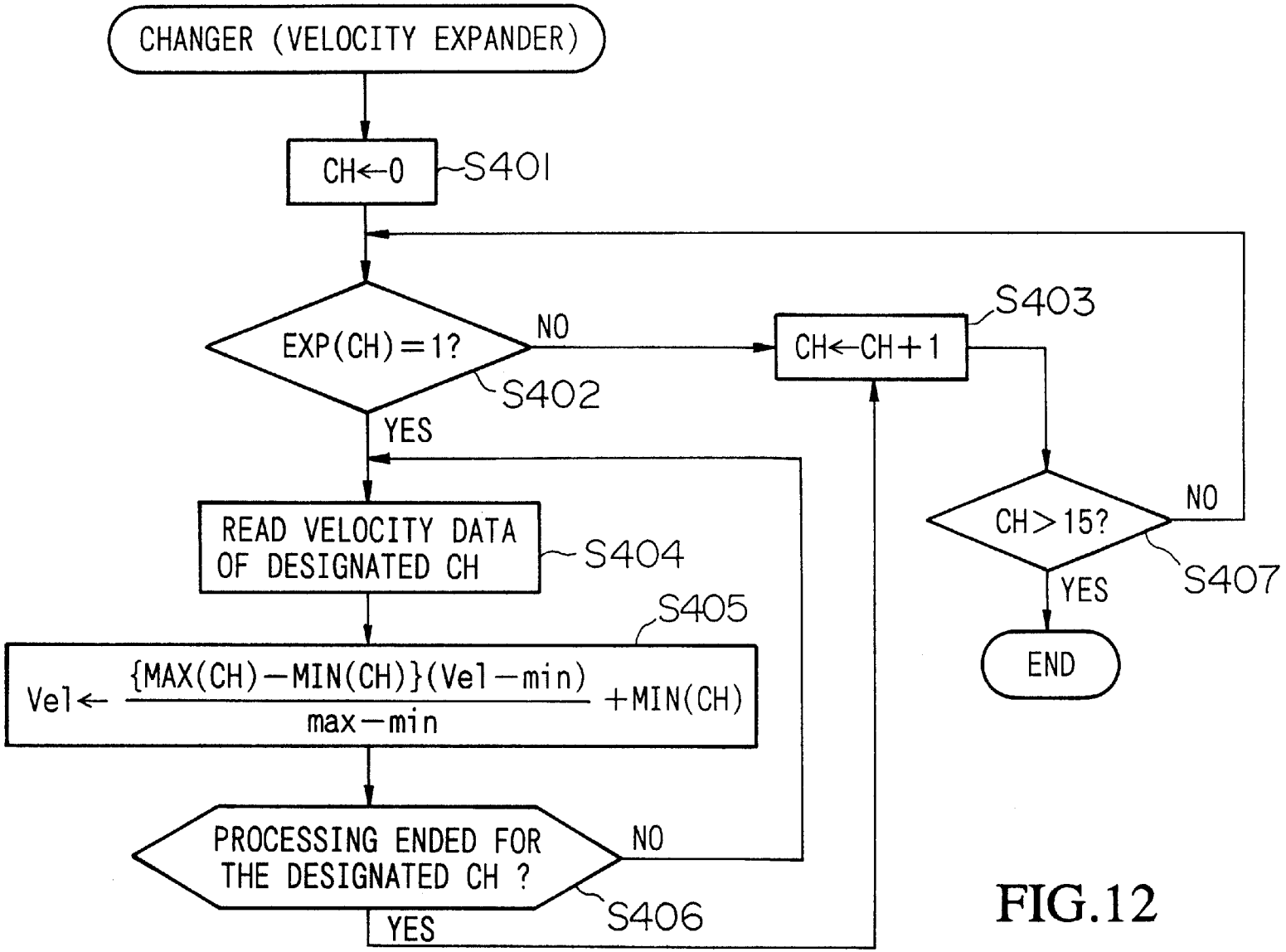
FIG. 12 is a flowchart showing a changer of the velocity expander editing process.

FIG. 12 shows a flow of steps regarding the changer of the velocity expander editing process. Herein, a first step S401 corresponding to initialization (or initial setting) of the channel number of the MIDI channel, wherein '0' is set to 'CH'. In step S402, a decision is made as to whether or not '1' is set to the register EXP(CH); in other words, a decision is made as to whether or not the MIDI channel corresponding to the currently designated channel number CH is designated for the velocity expander editing process. If a result of the decision is "NO", the channel number CH is increased by '1' in step S403. Then, the step S402 is repeated with respect to the increased channel number.

If it is detected that '1' is set to the register EXP(CH), the system accesses to the RAM 14 to sequentially read out velocity data Vel which are provided for the MIDI channel corresponding to the channel number CH in step S404. In step S405, the system performs calculations in accordance with an equation (1) so as to renew the velocity data Vel. So, the renewed velocity data (Vel) are stored back in the RAM 14.

$$Vel=[\{MAX(CH)-MIN(CH)\}\cdot(Vel-min)/(max-min)]+MIN(CH) \quad (1)$$

In the above equation (1), 'max' and 'min' represent the maximum value and minimum value of the velocity data which are provided for the MIDI channel corresponding to the channel number CH. So, those values have been calculated by the aforementioned analysis process of FIG. 11, so that they have been already stored in the RAM 14.

In step S406, a decision is made as to whether or not the system completely reads all the velocity data which are provided for the MIDI channel corresponding to the channel number CH. If a result of the decision is "NO", the system proceeds back to the step S404. Thus, the steps S404 and S405 are repeated with respect to remaining velocity data. Thereafter, when a result of the decision of the step S406 turns to "YES", the system proceeds to step S403 to increase the channel number CH by '1'. Then, the system proceeds to step S407 in which a decision is made as to whether or not the increased channel number is greater than '15'. If a result of the decision is "NO", the system proceeds back to step S402 which makes the aforementioned decision with respect to the increased channel number. So, if the system finds out another MIDI channel of the increased channel number which is designated for the velocity expander editing process, the aforementioned steps (see S404, S405, etc.) are repeated with respect to the found MIDI channel. Thereafter, when the system completes processing on all the MIDI channels, a result of the decision of the step S407 turns to "YES". Thus, an execution of the changer is ended.

Figure 13:
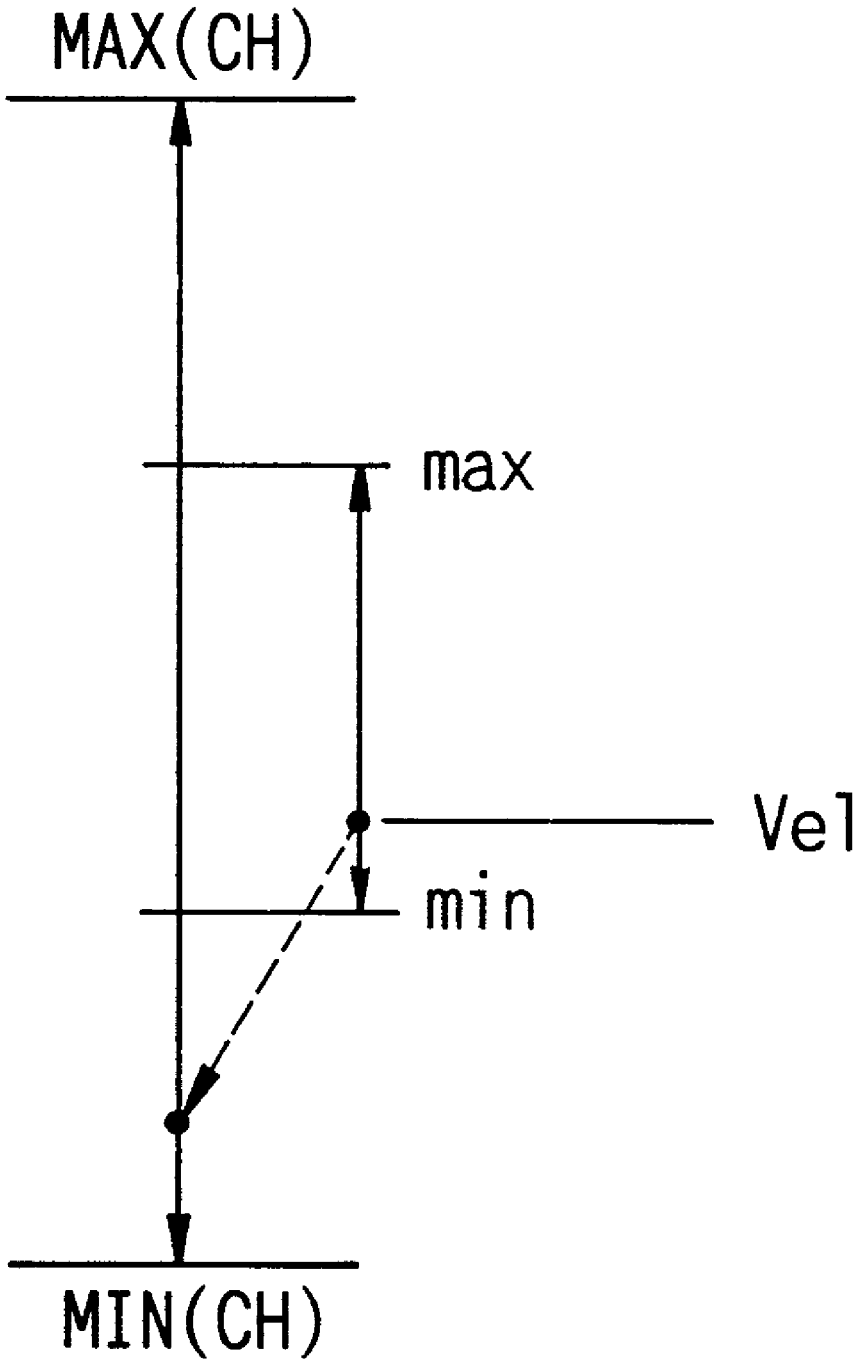
FIG. 13 is a drawing which is used to explain a broadening process of a distribution range of velocity data in accordance with the velocity expander editing process.

According to the processes described heretofore, a distribution range regarding all the velocity data corresponding to the MIDI channels which are designated for the velocity expander editing process is broadened to be kept in a range which is defined by the upper-limit value and lower-limit value which are set to the registers MAX(CH) and MIN(CH) respectively. FIG. 13 shows a broadening process of the distribution range of the velocity data. In FIG. 13, an original distribution range of the velocity data which is defined by the maximum value 'max' and minimum value 'min' is broadened to a new range which is defined by the upper-limit value and lower-limit value of the registers MAX(CH) and MIN(CH). Thanks to the adoption of the aforementioned equation (1), magnitude relationships between the velocity data of the original distribution range are maintained in the broadened range as well.

According to the present embodiment described above, it is possible to arbitrarily broaden the distribution range of the velocity data with respect to the designated MIDI channel (s). Thus, it is possible to arbitrarily enlarge ups and downs in variations of tone volumes of musical tones with respect to a specific part of the music played by the automatic performance. So, it is possible to impart a certain expression to the performance.

(3) Sound Duplication Editing Process

The sound duplication editing process deals with an existing key-on event which is assigned to a MIDI channel within MIDI channels, each corresponding to "DBL(CH)=1", which are designated for the sound duplication editing process. That is, the sound duplication editing process adds a 'duplicate' key-on event which duplicates the existing key-on event of the MIDI channel. If the addition of the duplicate key-on event is made unconditionally, there is a possibility that a shortage of tone-generation channels occurs. So, the sound duplication editing process is carried out by 2 stages, as follows:

At first, an analysis process is made to grasp a time-series-occurrence situation of 'existing' key-on events which occur in a time-series manner. After the analysis process, the system of the present embodiment performs an addition process to add a duplicate key-on event to the existing key-on event only when the present situation thereof meets a condition that a shortage of tone-generation channels may not occur.

The analysis process is carried out by an execution of the analyzer, whilst the addition process is carried out by an execution of the changer.

In the analysis process of the analyzer (which corresponds to step S204 shown in FIG. 8), a decision is made, with respect to each of key-on events assigned to the designated MIDI channel, as to whether or not a shortage of tone-generation channels occurs if an addition of a same key-on event is made. The contents of the process of the decision will be described with reference to time-series diagrams of FIGS. 14A to 14E. In those diagrams, blocks describing numerals such as 'KON1' and 'KON2' represent key-on events, whilst blocks describing numerals such as 'KOFF1' and 'KOFF2' represent key-off events. Herein, the key-off event is provided to terminate a sounding operation which is started responsive to the key-on event. So, each of the key-on events is accompanied with each of the key-off events by arrows. The key-on events and key-off events are extracted from performance data stored in the RAM 14. FIGS. 14A to 14E show time-series arrangements of pairs of the key-on events and key-off events which are arranged in a playback order corresponding to a progress of time (or a time axis).

Now, a description will be given with respect to examples of decisions to detect a shortage of tone-generation channels and with regard to situations shown by FIGS. 14A to 14E each. This description is made under a precondition that the sound source board (see '6' in FIG. 2) has 4 tone-generation channels. In addition, all the key-on events and key-off events shown in FIGS. 14A to 14E are supposed to be suited to MIDI channels which are designated for the sound duplication editing process.

Figures 14A, 14B, 14C, 14D, 14E:
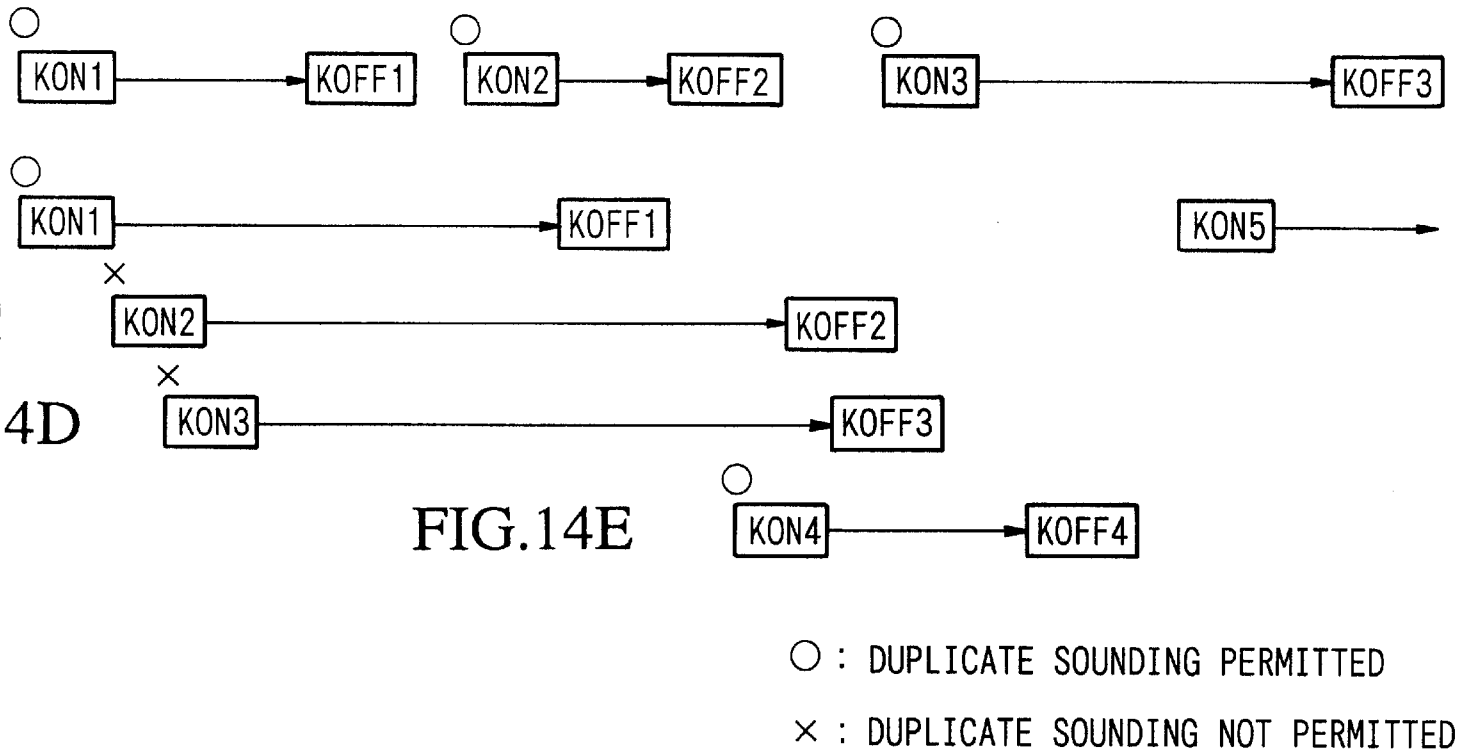
FIGS. 14A to 14E are time-series diagrams which are used to explain decisions regarding sound duplicating operations.

Suppose a situation shown in FIG. 14A where sounding durations of musical tones which are started by key-on events KON1, KON2 and KON3 do not overlap with each other on a time axis. Therefore, it is possible to add 'duplicate' key-on events with respect to the key-on events of KON1, KON2 and KON3 respectively.

Suppose a situation shown in FIGS. 14B to 14E where sounding durations of musical tones which are started by key-on events KON1 to KON5 are presented, wherein some of them partially overlap with each other on a time axis. So, studies are made as to a possibility to add a duplicate key-on event to the key-on events KON1 to KON5 each. Results of the studies are described hereinbelow.

At first, a study is made with respect to the key-on event KON1. Herein, no other musical tones are started at a sounding start timing of the key-on event KON1. However, the key-on events KON2 and KON3 occur in the sounding duration in which a sounding operation of the key-on event KON1 is sustained and is then terminated by the key-off event KOFF1. In this case, even if 3 musical tones are generated by the above 3 key-on events KON1, KON2 and KON3 respectively, there remains 1 tone-generation channel because the sound source board has 4 tone-generation channels. So, even if another musical tone is generated using the remaining tone-generation channel in the sounding duration of the key-on event KON1, there occurs no shortage of the tone-generation channels. Thus, as for the key-on event KON1, a result of the decision shows that a duplicate key-on event, which duplicates the key-on event KON1, can be added so that a same musical tone is generated using 2 tone-generation channels in a sound duplication manner.

Next, a study is made with respect to the key-on event KON2. According to the aforementioned result of the decision, 2 tone-generation channels are used to duplicate a same musical tone with regard to the key-on event KON1. So, 3 tone-generation channels are required to perform a sounding operation of the key-on event KON2 in addition to the sounding operations of the key-on event KON1. In addition, a sounding operation of the key-on event KON3 is started in the sounding duration that the sounding operation of the key-on event KON2 is sustained and is then terminated by the key-off event KOFF2. At a sounding start timing of the key-on event KON3, the sounding operation of the key-on event KON1 is still continuing. So, at this timing, 4 tone-generation channels are required to perform the sounding operation of the key-on event KON3 in addition to the sounding operations of the key-on events KON1 and KON2. If 2 tone-generation channels are used for the key-on event KON2, a shortage of tone-generation channels occurs at the sounding start timing of the key-on event KON3. For this reason, the system of the present embodiment makes a decision that duplicate sounding operations using 2 tone-generation channels are not permitted for the key-on event KON2.

Next, a study is made with respect to the key-on event KON3. According to results of the decisions described above, duplicate sounding operations are performed using 2 tone-generation channels with respect to the key-on event KON1, whilst a single sounding operation is performed using 1 tone-generation channel with respect to the key-on event KON2. Therefore, all of the 4 tone-generation channels are required to perform a sounding operation of the key-on event KON3 in addition to the sounding operations of the key-on events KON1 and KON2. This fact obviously shows that duplicate sounding operations using 2 tone-generation channels are not possible with regard to the key-on event KON3.

Next, a study is made with respect to the key-on event KON4. At a sounding start timing of the key-on event KON4, the sounding operations of the key-on event KON1 have been already ended. So, at this timing, 3 tone-generation channels are used to perform sounding operations of the key-on events KON2, KON3 and KON4. That is, 1 tone-generation channel is remained. In addition, no other key-on events are started in a sounding duration of the key-on event KON4 which is terminated by the key-off event KOFF4. Therefore, the system of the present embodiment makes a decision that duplicate sounding operations using 2 tone-generation channels can be permitted for the key-on event KON4.

The aforementioned decisions are made in accordance with a rule as follows:

A priority is given to a key-on event whose sound is played back first among 'overlapped' key-on events whose sounding durations partially overlap with each other on a time axis if a shortage of tone-generation channels occurs when duplicate sounding operations are performed with regard to any one of the overlapped key-on events. Thus, duplicate sounding operations are permitted for the key-on event given a priority.

Incidentally, it is possible to employ a variety of rules, which are presented to avoid conflicts between key-on events, other than the aforementioned rule. However, the detailed explanation of those rules is omitted.

In short, the analysis process of the sound duplication editing process operates based on the aforementioned rule (or principle) such that a decision is made as to whether or not to enable adoption of sound duplication with respect to each of key-on events assigned to the designated MIDI channel(s).

Figure 15:
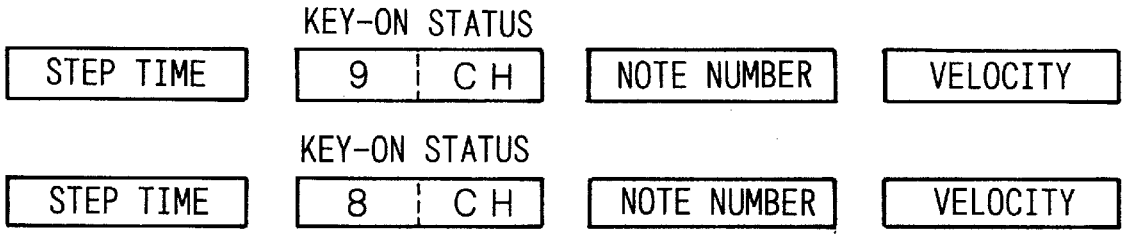
FIG. 15 shows a configuration of performance data in which a step time is added prior to each event.

In order to perform the above analysis process, it is necessary to grasp occurrence situations of key-on events and key-off events each in a time-series manner. So, the present embodiment refers to step times contained in performance data so as to calculate an occupation position of a sounding duration of each key-on event on a time axis. As shown in FIG. 15, data representing step times are provided prior to events of performance data. The step time represents a wait time which elapses between a playback timing of a preceding event and a playback timing of a current event, wherein a playback of the current event is started after the step time. As for a certain event, for example, the present embodiment calculates a sum of all the step times which are provided prior to the certain event. Thus, it is possible to set a 'relative' playback time to start a playback of the certain event on the basis of a start time of an automatic performance. So, the present embodiment performs such a calculation with respect to the key-on events and key-off events each. Thus, it is possible to calculate an occupation position on a time axis which corresponds to a sounding duration of a key-on event.

Figure 16:
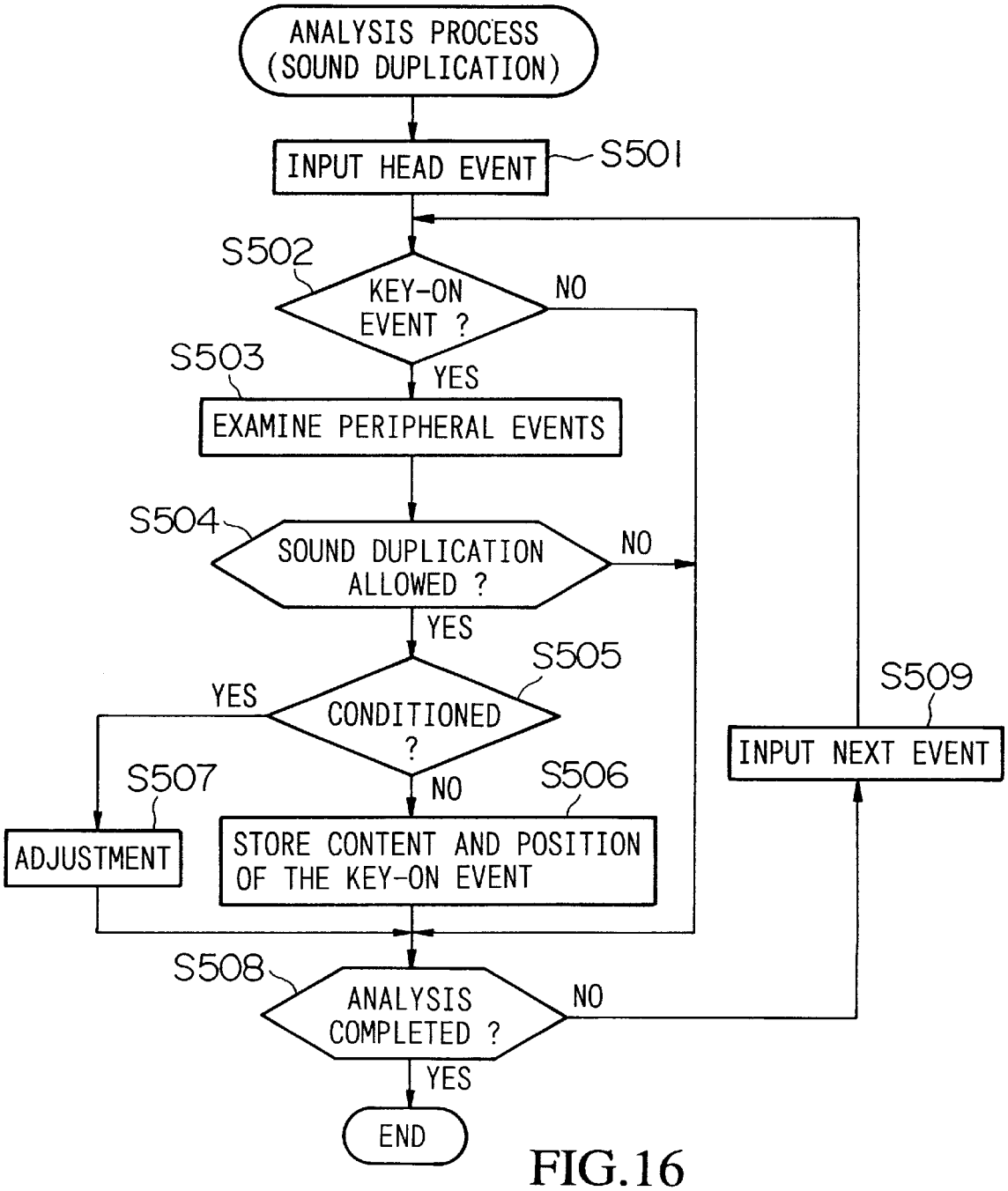
FIG. 16 is a flowchart showing an analysis process of a sound duplication editing process.

Next, a detailed description will be made with respect to the analysis process of the sound duplication editing process with reference to a concrete flowchart of FIG. 16. In first step S501, the system of the present embodiment inputs a head event from performance data which are provided for a MIDI channel which is designated for the sound duplication editing process. In next step S502, a decision is made as to whether or not the inputted head event corresponds to a key-on event. If a result of the decision is "YES", the system proceeds to step S503. If a result of the decision is "NO", the system proceeds directly to step S508.

In step S503, an examination is made on peripheral events which are provided in proximity to the key-on event currently inputted. Specifically, the system pays an attention to a sounding duration of each key-on event which is grasped based on a step time described before, thus performing an examination with respect to 2 points as follows:

(a) A decision is made as to whether or not the sounding duration of the key-on event currently inputted overlaps with another sounding duration of another key-on event on a time axis.

(b) In an overlap event that an overlap is detected between the sounding durations, a decision is made as to whether or not a shortage of tone-generation channels occurs if sound duplication is adopted to the key-on event currently inputted.

Next, the system proceeds to step S504 which makes a decision based on results of the examination made by the step S503. Specifically, a decision is made as to whether or not sound duplication can be adopted to the currently inputted key-on event.

Results of the above decision is divided into 3 courses of decision which will be described below.

(a) First course of decision where sound duplication is allowed unconditionally.

FIG. 17A shows an example of a situation where the system takes the first course of decision. Herein, a sounding duration of a key-on event KON1 does not at all overlap with a sounding duration of a key-on event KON2 or other sounding durations. So, if the currently inputted key-on event coincides with the key-on event KON1 or KON2, the system can take the first course of decision where the sound duplication can be adopted to the currently inputted key-on event unconditionally.

(b) Second course of decision where sound duplication is allowed under a certain condition.

The system takes the second course of decision in a case where the currently inputted key-on event conflicts with other key-on events. In that case, a decision, which is made as to whether or not sound duplication can be adopted to the currently inputted key-on event, depends upon a decision which is made as to whether or not sound duplication is adopted to the other key-on events.

FIG. 17B shows an example of a situation where the above decisions are made. Herein, sounding durations of 3 key-on events KON1, KON2 and KON3 overlap with each other on a time axis. This indicates that the system allows an adoption of sound duplication on one of the 3 key-on events only. In addition, a sounding duration of a key-on event KON4 overlaps with the sounding durations of the key-on events KON2 and KON3. So, an adoption of sound duplication is allowed on the key-on event KON4 only when sound duplication is not adopted to both of the key-on events KON2 and KON3. Therefore, if the currently inputted key-on event coincides with the aforementioned key-on events KON1 to KON4 shown in FIG. 17B, a decision, which is made as to whether or not sound duplication can be adopted to the currently inputted key-on event, depends on a decision which is made as to whether or not sound duplication is adopted to other key-on events which conflict with the currently inputted key-on event.

(c) Third course of decision where there is no room to allow an adoption of sound duplication on the currently inputted key-on event.

The system takes the third course of decision in a situation where an addition of a key-on event cannot be carried out, in other words, a situation where a shortage of tone-generation channels is certainly caused to occur by an addition of a key-on event because all the tone-generation channels are used.

If a result of the decision of the step S504 corresponds to the first or second course of decision described before, the system proceeds to step S505. If a result of the decision of the step S504 corresponds to the third course of decision, the system proceeds directly to step S508.

In step S505, a decision is made as to whether or not the result of the decision of the step S504 corresponds to the second course of decision. If a result of the decision of the step S505 is "NO", the system proceeds to step S506 in which the RAM 14 stores the content of the currently inputted key-on event as well as information which represents a position of the currently inputted key-on event on a time axis. Thereafter, the system proceeds to step S508.

On the other hand, if a result of the decision of the step S505 is "YES", in other words, if the currently inputted key-on event is matched with the aforementioned second course of decision, the system proceeds to step S507 in which an adjustment is carried out to avoid conflicts. The adjustment is performed in accordance with the aforementioned rule which is described before with reference to FIGS. 14A to 14E. According to this rule, a key-on event which is played back at first among key-on events which conflict with each other is given a priority to allow an adoption of sound duplication. Or, it is possible to use another method according to which key-on events which conflict with each other are visually displayed on a screen of the CRT display unit 2 so that a user can select any one key-on event on which an adoption of sound duplication is allowed. After determination of the key-on event on which an adoption of sound duplication is allowed, the content of the key-on event as well as information representing a position of the key-on event on a time axis are stored in the RAM 14. Thereafter, the system of the present embodiment proceeds to step S508.

In step S508, a decision is made as to whether or not the aforementioned steps are executed on all the events assigned to the designated MIDI channel which is designated for the sound duplication editing process. That is, a decision is made as to whether or not the analysis can be completed. If a result of the decision is "NO", the system of the present embodiment inputs a next event in step S509. Then, the system proceeds back to the step S502. Thereafter, the aforementioned steps of S502 to S508 are repeated with respect to the next event assigned to the designated MIDI channel. If the steps are completely performed on all the events of the designated MIDI channel, a result of the decision of the step S508 turns to "YES", so that the system ends an execution of the analyzer (i.e., analysis process) of the sound duplication editing process.

A changer of the sound duplication editing process is executed in accordance with a flow of steps shown in FIG. 18. In first step S601, an initialization (or initial setting) is carried out on a channel number 'CH' of a MIDI channel, thus CH=0. In next step S602, a decision is made as to whether or not '1' is set to the doubler register DBL(CH). In other words, a decision is made as to whether or not the MIDI channel of the channel number CH currently designated is designated for the sound duplication editing process. If a result of the decision is "NO", the channel number CH is increased by '1' in step S605. Thereafter, the system of the present embodiment repeats the step S602.

On the other hand, if it is detected that '1' is set to the doubler register DBL(CH), the system proceeds to step S603 so as to perform a key-on-event insertion process. According to the key-on-event insertion process, events assigned to the MIDI channel of the channel number CH are sequentially read out from one area of the RAM 14 and are then transferred to another area of the RAM 14. At this time, the system refers to information, stored in the RAM 14, which is provided with respect to each of the key-on events by the aforementioned execution of the analyzer. Thus, the system makes a decision as to whether or not each of the events read out from the RAM 14 is accompanied with an adoption of sound duplication. So, the system additionally provides a same key-on event which corresponds to the key-on event accompanied with an adoption of sound duplication, so that the key-on event additionally provided is written into the RAM 14. After completion of the key-on-event insertion process described above, the system proceeds to step S605 to increase the channel number CH by '1'. Then, the system proceeds to step S604 in which a decision is made as to whether or not the increased channel number is greater than '15'. If a result of the decision is "NO", the system proceeds back to step S602. So, the aforementioned steps are repeated. Thereafter, when the channel number becomes greater than '15', a result of the decision of the step S604 turns to "YES" so that the system ends an execution of the changer shown in FIG. 18.

According to the present embodiment described heretofore, it is possible to allow an adoption of sound duplication on a key-on event of a desired MIDI channel. Thus, it is possible to produce a 'marrowy' and 'thick' sound with respect to a desired part of the music.

(4) Timing Tuner Editing Process

Figure 19:
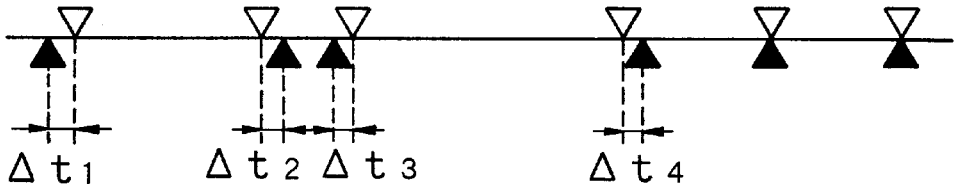
FIG. 19 shows relationships between playback timings, designated for a timing tuner editing process, and desired playback timings, requested by a user, which are deviated from each other with deviation times.

At first, a brief description will be given with respect to the timing tuner editing process with reference to FIG. 19. In FIG. 19, a straight line drawn in a horizontal direction represents a time axis. Herein, 'white' triangle marks '▽' disposed above the time axis represent a series of playback timings of key-on events which are designated for the timing tuner editing process, whilst 'black' triangle marks '▲' disposed below the time axis represent a series of sounding timings which are requested by the user.

The timing tuner editing process is designed to perform corrections of playback timings with respect to key-on events or key-off events of a designated MIDI channel (where TUN(CH)=1) which is designated for the timing tuner editing process. The corrections are performed such that each event is played back at a timing which is requested by the user. The timing tuner editing process consists of an analysis process and a correction process. The analysis process is performed to produce a deviation time measured between a playback timing of an 'existing' key-on event (or an existing key-off event) and a playback timing which is requested by the user. That is, the analysis process sequentially produce deviation times $\Delta t_1$, $\Delta t_2$, . . . The correction process operates based on results of the analysis process to perform corrections on playback timings regarding the key-on events and key-off events respectively. In order to accomplish the above processes, the timing tuner editing process consists of an analyzer and a changer. Herein, the analyzer is a program which corresponds to the analysis process, whilst the changer is a program which corresponds to the correction process.

Prior to an execution of the analyzer, it is necessary to prepare data representing playback timings which the user requests. 2 methods are provided to produce the above data.

(a) First method which responds to a real performance actually played by the user.

For example, the user uses an electronic musical instrument to play music performance on a specific part (e.g., rhythm part), so that real performance data are produced. The real performance data are supplied to the performance data editing apparatus via the MIDI interface 17. So, playback timings of key-on events (or key-off events) stored in the real performance data are used as 'requested' playback timings which are requested by the user.

Figure 20:
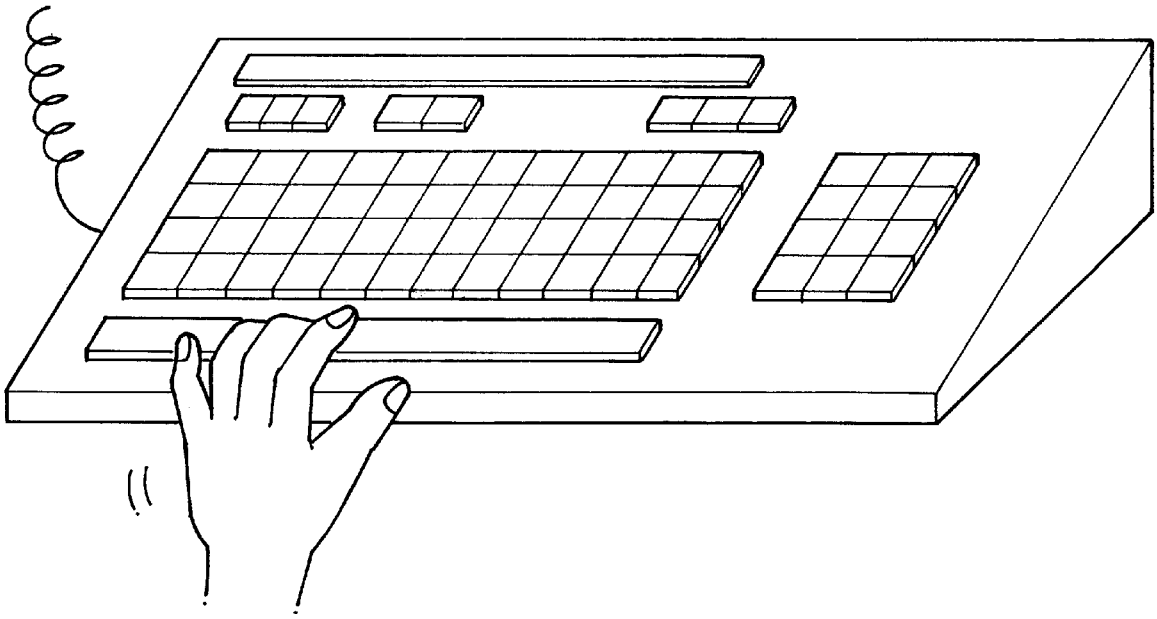
FIG. 20 is a perspective view illustrating a panel face of a keyboard which is manipulated by a user to create real performance data representing desired playback timings.

(b) Second method in which real performance data are created to designate desired playback timings which are designated by the user to strike a space key of the keyboard 3 (see FIG. 20).

In order to use the second method, the user switches over the operation mode of the performance data editing apparatus to set the MIDI data creation mode; then, the user conducts a rhythm performance only using the space key of the keyboard 3. Herein, the user depresses the space key at a timing to start sounding; and the user releases the space key at a timing to end the sounding. Because of such a simple action of the space key, the second method may be convenient for the user who is not accustomed to the playing of the electronic musical instrument.

Figure 21:
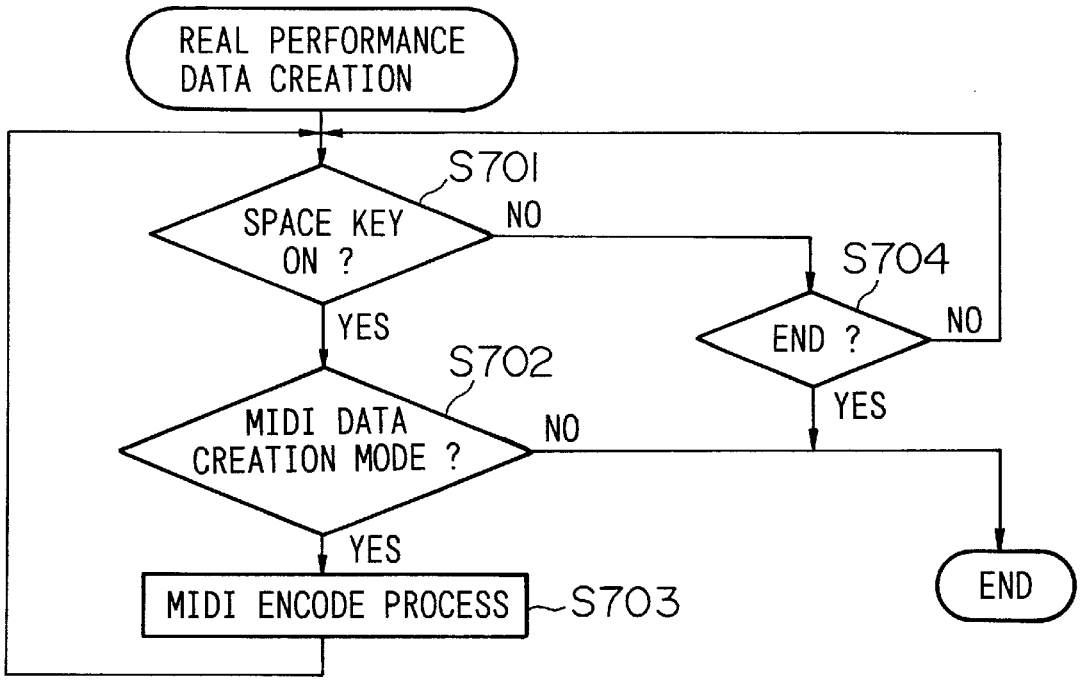
FIG. 21 is a flowchart showing a real-performance-data creation program.

FIG. 21 shows a flow of steps corresponding to a real-performance-data creation program which creates real performance data representing playback timings of key-on events of 'rhythm' musical tones in accordance with the second method.

Next, a description will be given with respect to the content of the real-performance-data creation program.

This program is started by an input of a certain command. In first step S701, a decision is made as to whether or not an ON event (i.e., a depression event) occurs on the space key. If a result of the decision is "NO", the system of the present embodiment proceeds to step S704. In step S704, a decision is made as to whether or not an end of processing is designated; in other words, a decision is made as to whether or not an END button (not shown) is depressed. If a result of the decision is "NO", the system proceeds back to the step S701.

If an ON event occurs on the space key, a result of the decision of the step S701 turns to "YES", so that the system proceeds to step S702. In step S702, a decision is made as to whether or not the operation mode currently designated is the MIDI data creation mode. If a result of the decision is "NO", the system ends an execution of the program without creating any data.

On the other hand, if a result of the decision of the step S702 is "YES", the system proceeds to step S703 so as to execute a MIDI encode process. According to the MIDI encode process, the system creates a step time corresponding to a lapse of time which elapses after the starting of the program of FIG. 21 as well as a certain key-on event. Then, the step time and key-on event created are written into a certain area of the RAM 14. After completion of the writing, a program control goes back to the step S701 again.

Thereafter, when an ON event occurs on the space key again, the system proceeds to step S703 through steps S701 and S702, wherein the MIDI encode process is executed again. In this case, the system creates a step time representing a lapse of time, which elapses until now after the aforementioned writing of the step time and key-on event, as well as a certain key-on event. So, the step time and key-on event newly created are written into a certain area of the RAM 14. Thereafter, every time an ON event is detected on the space key, a pair of step time and key-on event are written into the RAM 14. If the manipulation of the space key is broken, and an end of processing is designated, a result of the decision of the step S704 turns to "YES" so that the system ends an execution of the program.

According to the execution of the program, it is possible to provide the RAM 14 with the real performance data representing the desired playback timings of key-on events which are requested by the user.

In some case, the user manipulates the space key so as to create playback timings corresponding to both of key-on events and key-off events with respect to 'continuing' musical tones whose sounding is continued for a while. In that case, the program of FIG. 21 is modified to add some processes which cope with ON events of the space key as well as OFF events of the space key.

Figure 22:
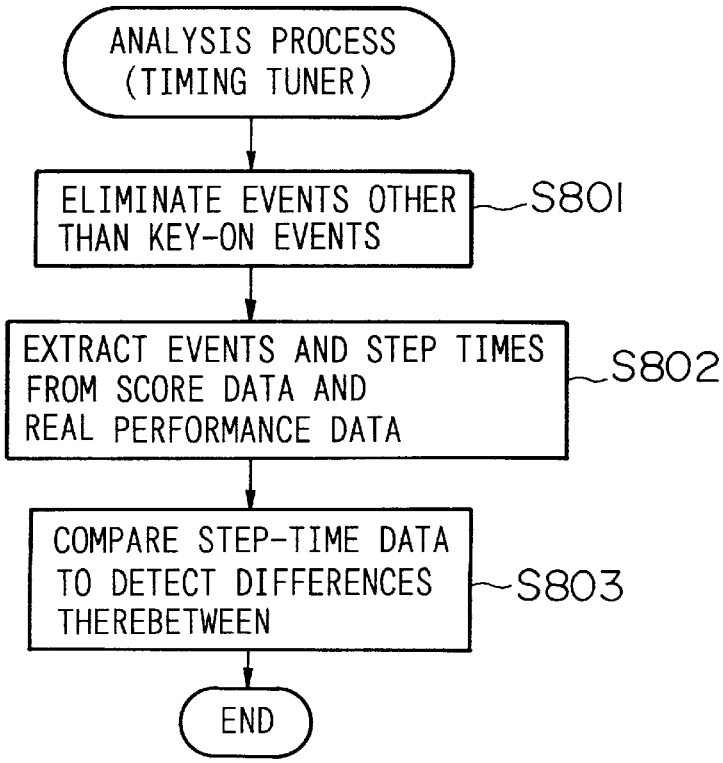
FIG. 22 is a flowchart showing an analysis process of the timing tuner editing process.

After the real performance data are produced as described above, the system nextly performs an analyzer. That is, the system performs an analysis process of FIG. 22 with respect to the designated MIDI channel (where TUN(CH)=1) which is designated for the timing tuner editing process. In first step S801, the system creates score data, representing the content of a score of the music to be played, based on performance data stored in the RAM 14. Specifically, the score data are created by eliminating events, other than key-on events, from the performance data. That is, the system accesses to the RAM 14 so as to sequentially read out step times which are inserted between a series of events assigned to the designated MIDI channel. In parallel with the sequentially reading of the step times, the system performs 3 processes as follows:

(a) Step times are sequentially read out and are accumulated before the reading of a key-on event.

(b) When reading out the key-on event, an accumulation value of the step times and the key-on event are written into a storage area of the RAM 14 which is provided for the score data.

(c) After completion of the writing, the accumulation value of the step times is reset to '0'; then, the above process (a) is repeated.

As a result of an execution of the above processes, it is possible to obtain score data, which do not contain the events other than the key-on events, in the RAM 14 when the system completely reads out all the events assigned to the designated MIDI channel.

Next, the system proceeds to step S802 in which events and step times are extracted from the score data and real performance data in the RAM 14 respectively. Herein, each of the step times extracted from the score data may correspond to each of the step times extracted from the real performance data. So, in step S803, the step time of the score data and its corresponding step time of the real performance data are compared with each other, so that a difference therebetween is calculated. That is, the system sequentially calculates the deviation times $\Delta t_1$, $\Delta t_2$, . . . shown in FIG. 19. Such a difference is written into the RAM 14 In connection with each key-on event. Thereafter, the system ends an execution of the analysis process.

Figure 23:
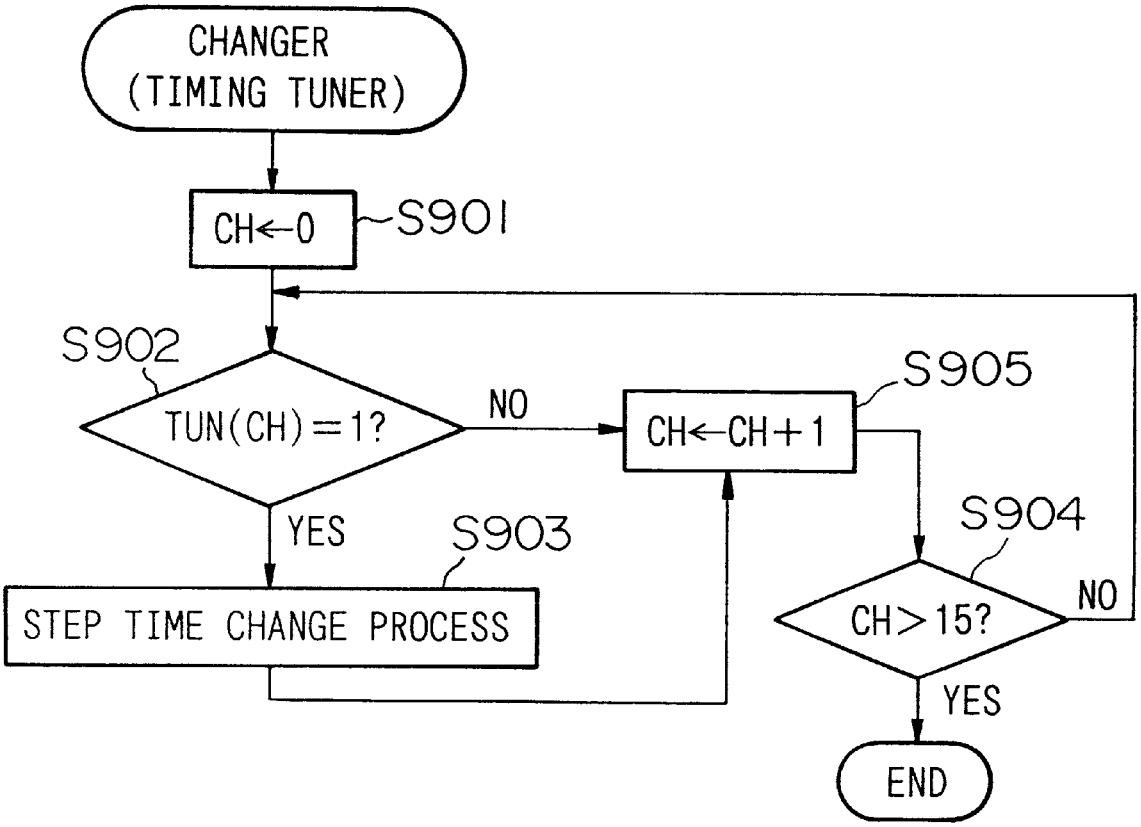
FIG. 23 is a flowchart showing a changer of the timing tuner editing process.

Next, the system executes a changer of the timing tuner editing process in accordance with a flow of steps shown in FIG. 23. In first step S901, an initialization is performed on the channel number CH of the MIDI channel, thus CH=0. In next step S902, a decision is made as to whether or not '1' is set to the tuner register TUN(CH); in other words, a decision is made as to whether or not the MIDI channel corresponding to the channel number CH currently designated is designated for the timing tuner editing process. If a result of the decision is "NO", the channel number CH is increased by '1' in step S905. Then, the system repeats the step S902.

On the other hand, if it is detected that '1' is set to the tuner register TUN(CH), the system proceeds to step S903 so as to perform a step time change process. Herein, events assigned to the MIDI channel of the channel number CH are sequentially read out from one area of the RAM 14 one by one. Then, the read events are sequentially written into another area of the RAM 14. If a key-on event is read out, the system refers to a step-time difference (i.e., deviation time) which is stored in the RAM 14 in connection with the key-on event. So, a correction corresponding to the difference is performed on a step time preceding the key-on event. Then, the 'corrected' step time together with the key-on event are written into the RAM 14. As a result of the correction process described above, playback timings of key-on events assigned to the designated MIDI channel are each corrected to coincide with playback timings of key-on events of the real performance data. In the above correction process, a correction is made by directly using the difference as a correction value. However, it is possible to use a 'reduced' difference, which is produced by multiplying the difference by a certain coefficient which is less than '1', as the correction value. By using such a reduced difference, it is possible to shift the playback timing of the key-on event to be close to the key-on timing of the real performance data.

After completion of the step time change process of the step S903, the system proceeds to step S905 to increase the channel number CH by '1'. Then, the system proceeds to step S904 in which a decision is made as to whether or not the increased channel number is greater than '15'. If a result of the decision is "NO", the system proceeds back to the step S902. So, the aforementioned steps are repeated. Thereafter, when the channel number becomes greater than '15', a result of the decision of the step S904 turns to "YES" so that the system ends an execution of the changer.

In the present embodiment described heretofore, the timing tuner editing process is capable of performing a fine adjustment on performance data in such a way that playback timings of musical tones in a specific part of the music will coincide with 'desired' timings which are requested by the user. Thus, it is possible to adjust an automatic performance of the music in accordance with an intention of the user; or it is possible to put the user's heart and soul into the computer music.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A performance data editing apparatus comprising:

performance data storing means for storing performance data corresponding to a plurality of parts of a music piece which is played by an automatic performance;

part designating means for designating at least one of the plurality of parts as an editing part which is designated for editing; and editing means for performing a tone volume expander editing process on the performance data of the editing part so as to broaden a distribution range of tone volume data representing tone volumes of musical tones of the editing part, wherein all of the tone volumes of the editing part are subjected to uniform expansion, within a progress of performance of the musical tones in the editing part, according to a desired scale.

2. A performance data editing apparatus comprising:

performance data storing means for storing performance data corresponding to a plurality of parts of a music piece, wherein an automatic performance is made using a number of tone-generation channels based on the performance data;

part designating means for designating at least one of the plurality of parts as an editing part which is designated for editing; and editing means for performing a sound duplication editing process on the performance data of the editing part so as to duplicate generation of a same musical tone which belongs to the editing part, wherein a note event which is the same as the musical tone of the performance data is inserted only into an available vacant channel and without creating a shortage of channels.

3. A performance data editing apparatus according to claim 2 wherein the editing means further comprises:

analysis means for analyzing an overlapping situation of sounding durations of musical tones of the editing part so as to make a decision to duplicate the generation of the same musical tone under a condition where a shortage of the number of tone-generation channels does not occur; and duplication means, which is activated by the decision made by the analysis means, for duplicating the generation of the same musical tone with respect to the editing part.

4. A performance data editing apparatus comprising:

a performance data memory for storing performance data corresponding a plurality of parts of a music piece to be played;

a part designation section for designating at least one of the plurality of parts as an editing part which is designated for editing; and a tone volume adjusting section for adjusting each of a plurality of tone volume data corresponding to musical tones included in the editing part in such a way that an overall range of tone volumes of the tone volume data belonging to the editing part is uniformly changed, within a progress of performance of the musical tones in the editing part, to be placed within a desired range while maintaining magnitude relationships between each of the tone volume data.

5. A performance data editing apparatus comprising:

a performance data memory for storing performance data corresponding to a plurality of parts of a music piece to be played;

a part designation section for designating at least one of the plurality of parts as an editing part which is designated for editing; and a performance data adding section for performing an examination on sounding durations of musical tones which are generated based on the performance data, wherein the performance data adding section adds data to the performance data, by inserting only into an available vacant channel and without creating a shortage of channels a note event which is the same as a musical tone of the performance data, under a condition where a number of musical tones to be simultaneously generated is less than a predetermined number on the basis of a result of the examination so as to duplicate generation of the same musical tone which belongs to the editing part.

6. A performance data editing method comprising the steps of:

storing performance data corresponding a plurality of parts of a music piece to be played;

designating at least one of the plurality of parts as an editing part which is designated for editing; and adjusting each of a plurality of tone volume data corresponding to musical tones included in the editing part in such a way that an overall range of tone volumes of the tone volume data belonging to the editing part is uniformly changed, within a progress of performance of the musical tones in the editing part, to be placed within a desired range while maintaining magnitude relationships between each of the tone volume data.

7. A performance data editing method comprising the steps of:

storing performance data corresponding to a plurality of parts of a music piece to be played;

designating at least one of the plurality of parts as an editing part which is designated for editing;

performing an examination on sounding durations of musical tones which are generated based on the performance data; and adding data to the performance data under a condition where a number of musical tones to be simultaneously generated is less than a predetermined number on the basis of a result of the examination so as to duplicate generation of a same musical tone which belongs to the editing part, wherein a note event which is the same as the musical tone of the performance data is inserted only into an available vacant channel and without creating a shortage of channels.

8. A storage device storing programs which cause a computerized machine to execute a performance data editing method comprising the steps of:

storing performance data corresponding a plurality of parts of a music piece to be played;

designating at least one of the plurality of parts as an editing part which is designated for editing; and adjusting each of a plurality of tone volume data corresponding to musical tones included in the editing part in such a way that an overall range of tone volumes of the tone volume data belonging to the editing part is uniformly changed, within a progress of performance of the musical tones in the editing part, to be placed within a desired range while maintaining magnitude relationships between each of the tone volume data.

9. A storage device storing programs which cause a computerized machine to execute a performance data editing method comprising the steps of:

storing performance data corresponding to a plurality of parts of a music piece to be played;

designating at least one of the plurality of parts as an editing part which is designated for editing;

performing an examination on sounding durations of musical tones which are generated based on the performance data; and adding data to the performance data under a condition where a number of musical tones to be simultaneously generated is less than a predetermined number on the basis of a result of the examination so as to duplicate generation of a same musical tone which belongs to the editing part, wherein a note event which is the same as the musical tone of the performance data is inserted only into an available vacant channel and without creating a shortage of channels.

* * * * *